US008175498B2

(12) United States Patent
Yamada et al.

(10) Patent No.: US 8,175,498 B2
(45) Date of Patent: May 8, 2012

(54) IMAGE FORMING APPARATUS AND METHOD THAT CHARGES LATENT IMAGE CARRIER

(75) Inventors: Yoichi Yamada, Shiojiri (JP); Masaru Kobashi, Matsumoto (JP); Mikio Furumizu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 424 days.

(21) Appl. No.: 12/552,194

(22) Filed: Sep. 1, 2009

(65) Prior Publication Data

US 2010/0061764 A1 Mar. 11, 2010

(30) Foreign Application Priority Data

Sep. 11, 2008 (JP) ..... 2008-232894

(51) Int. Cl.
*G03G 15/02* (2006.01)

(52) U.S. Cl. ..... 399/168; 399/170; 399/171

(58) Field of Classification Search ..... 399/168, 399/170, 171, 174, 222, 265, 266, 274
See application file for complete search history.

(56) References Cited

U.S. PATENT DOCUMENTS

| | | | | |
|---|---|---|---|---|
| 4,385,822 | A * | 5/1983 | Kanbe | 399/2 |
| 4,447,144 | A * | 5/1984 | Gibson | 399/165 |
| 4,827,869 | A * | 5/1989 | Takagi | 399/232 |
| 5,321,471 | A * | 6/1994 | Ito et al. | 399/129 |
| 5,751,405 | A * | 5/1998 | Aita et al. | 399/150 |
| RE36,935 | E * | 10/2000 | Haneda et al. | 399/302 |
| 6,856,777 | B2 | 2/2005 | Enomoto et al. | 399/128 |
| 2003/0053820 | A1 | 3/2003 | Enomoto et al. | 399/128 |
| 2009/0110443 | A1 * | 4/2009 | Yamada et al. | 399/284 |

FOREIGN PATENT DOCUMENTS

| | | | |
|---|---|---|---|
| JP | 62143075 | A * | 6/1987 |
| JP | 02189565 | A | 7/1990 |
| JP | 09-230693 | | 9/1997 |
| JP | 2003-091164 | | 3/2003 |
| JP | 2007-127800 | | 5/2007 |

* cited by examiner

*Primary Examiner* — David Gray
*Assistant Examiner* — G. M. Hyder
(74) *Attorney, Agent, or Firm* — DLA Piper LLP (US)

(57) ABSTRACT

An image forming apparatus includes: a latent image carrier; a first charging unit which charges the latent image carrier; a second charging unit which supplies a charge having a reverse polarity of the charged polarity of the toner; a toner carrying roller which carries a toner layer containing both a contact toner which comes in direct contact with the surface of the toner carrying roller and a non-contact toner which comes in contact with the contact toner and does not come in contact with the surface of the toner carrying roller; an electric field forming unit which develops the electrostatic latent image by the toner by generating an alternate electric field as a toner fly electric field between the latent image carrier and the toner carrying roller; and a transfer unit which transfers a toner image formed by developing the electrostatic latent image to a transfer medium.

13 Claims, 11 Drawing Sheets

FIG. 5

CHARGE AMOUNT (−) ↑ ↓ (+)

| CHARGE STATE OF TONER | DOT REPRODUCIBILITY | SOLID REPRODUCIBILITY | FLYING | GROUND FOGGING |
|---|---|---|---|---|
| REGULAR HIGH-CHARGE TONER | ○ | △ | ○ | △ (TRANSFER) |
| REGULAR LOW-CHARGE TONER | △ | ○ | △ | ○ |
| REVERSE LOW-CHARGE TONER | — | — | △ | × (NO TRANSFER) |
| REVERSE HIGH-CHARGE TONER | — | — | ○ | × (NO TRANSFER) |

MEANING OF SIGNS
○ : EXCELLENT
△ : SLIGHT EXCELLENT
× : POOR
— : IRRELATIVE

○ REGULAR CHARGE TONER

○ REGULAR CHARGE EXTERNAL ADDITIVES

● NON-CHARGE TONER

● NON-CHARGE EXTERNAL ADDITIVES

◍ REVERSE CHARGE TONER

◍ REVERSE CHARGE EXTERNAL ADDITIVES

DIAMETER OF
TONER PARTICLE Dt=4.5 $\mu$m

| SIGN | MAGNITUDE OF FLY START ELECTRIC FIELD |
|---|---|
| E0 | $8.6\times10^{6}$ V/m |
| E1 | $7.1\times10^{6}$ V/m |
| E2 | $3.9\times10^{6}$ V/m |

IMAGE FORMING APPARATUS AND METHOD THAT CHARGES LATENT IMAGE CARRIER

BACKGROUND

1. Technical Field

The present invention relates to an image forming apparatus and an image forming method of developing an electrostatic latent image by the use of toner in a state where a latent image carrier carrying the electrostatic latent image and a toner carrying roller carrying the toner are opposed to each other in a non-contact manner.

2. Related Art

As a technique for developing an electrostatic latent image by the use of toner, there is known a technique of so-called non-contact development method, where a latent image carrier for carrying an electrostatic latent image and a toner carrying roller for carrying the toner are opposed to each other with a gap therebetween and the electrostatic latent image is developed by causing the toner to fly through the gap (for example, see JP-2007-127800). In such a kind of image forming apparatus, toner having a volume average particle diameter of about 8 μm to about 10 μm has mainly been used until now. However, in order to achieve goals such as highly precise image, a high speed process, and a low fixing temperature, the toner is required to have a smaller particle size (for example, a volume average particle diameter of 5 μm or less).

It has recently been revealed that the toner with this smaller diameter behaves in a different manner from the toner with a larger diameter. For example, since an image force or the van der Waals force of the toner carrying roller on the charged toner having a small particle diameter is increased, it is difficult for the charged toner to fly from the toner carrying roller. Therefore, it is difficult to develop an image with a sufficient density. Moreover, since the toner having a small diameter and a small mass easily flies, the toner may become attached to the inside or the outside of the image forming apparatus or ground fogging may occur, thereby smearing the image to be formed.

Here, the lack of development density can be supplemented by increasing the amount of toner to be transmitted on the toner carrying roller or by strengthening an electric field to be generated in the gap between the latent image carrier and the toner carrying roller. However, even in this case, a problem arises in that too much toner flies. A goal of obtaining the sufficient development density is contrary to a goal of suppressing the toner flying to the inside and outside of the image forming apparatus or the ground fogging. Therefore, in order to achieve the smaller particle diameter of the toner while achieving these goals together, the known technique has to be improved.

SUMMARY

An advantage of some aspects of the invention is that it provides a technique for obtaining a sufficient development density and suppressing toner flying or ground fogging in an image forming apparatus of a non-contact development method of opposing a latent image carrier to a toner carrying roller with a gap therebetween and an image forming method.

According to an aspect of the invention, there is a provided an image forming apparatus including: a latent image carrier which rotates in a predetermined movement direction and carries an electrostatic latent image on a surface thereof; a first charging unit which charges the latent image carrier with a surface potential having the same polarity as a charged polarity of toner at a first charge position; a second charging unit which supplies a charge having a reverse polarity of the charged polarity of the toner toward the surface of the latent image carrier at a second charge position located on a downstream side of the first charge position in a movement direction of the latent image carrier; a latent image forming unit which forms the electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region; a toner carrying roller which is formed in a roller shape, is disposed to face the latent image carrier with a predetermined gap therebetween at a development position located on the downstream side of the latent image formation position in the movement direction of the latent image carriers and carries a toner layer containing both a contact toner which comes in direct contact with the surface of the toner carrying roller and a non-contact toner which comes in contact with the contact toner and does not come in contact with the surface of the toner carrying roller; an electric field forming unit which develops the electrostatic latent image by the toner at the development position by generating an alternate electric field as a toner fly electric field between the latent image carrier and the toner carrying roller; and a transfer unit which transfers a toner image formed by developing the electrostatic latent image to a transfer medium at a transfer position located on the downstream side of the development position in the movement direction of the latent image carrier.

According to another aspect of the invention, there is provided an image forming apparatus including; a latent image carrier which rotates in a predetermined movement direction and carries an electrostatic latent image on a surface thereof; a first charging unit which charges the latent image carrier with a surface potential having the same polarity as a charged polarity of toner at a first charge position; a second charging unit which charges attachments attached on the surface of the latent image carrier with a reverse polarity of the charged polarity of the toner at a second charge position located on a downstream side of the first charge position in a movement direction of the latent image carrier; a latent image forming unit which forms the electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region; a toner carrying roller which is formed in a roller shape, is disposed to face the latent image carrier with a predetermined gap therebetween at a development position located on the downstream side of the latent image formation position in the movement direction of the latent image carrier, and carries a toner layer containing both a contact toner which comes in direct contact with the surface of the toner carrying roller and a non-contact toner which comes in contact with the contact toner and does not come in contact with the surface of the toner carrying roller; an electric field forming unit which develops the electrostatic latent image by the toner at the development position by generating an alternate electric field as a toner fly electric field between the latent image carrier and the toner carrying roller; and a transfer unit which transfers a toner image formed by developing the electrostatic latent image to a transfer medium at a transfer position located on the downstream side of the development position in the movement direction of the latent image carrier.

According to still another aspect of the invention, there is provided an image forming method including: charging a rotating latent image carrier with a surface potential having the same polarity as a charged polarity of toner at a first charge position; supplying a charge having a reverse polarity of the charged polarity of the toner toward the surface of the latent image carrier at a second charge position located on a downstream side of the first charge position in a movement direction of the latent image carrier; forming an electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region; disposing a toner carrying roller, which is formed in a roller shape and carries a toner layer containing both a contact toner which comes in direct contact with the surface of the toner carrying roller and a non-contact toner which comes in contact with the contact toner and does not come in contact with the surface of the toner carrying roller, to face the latent image carrier with a predetermined gap therebetween at a development position located on the downstream side of the latent image formation position in the movement direction of the latent image carrier; developing the electrostatic latent image by the toner at the development position by generating an alternate electric field as a toner fly electric field between the latent image carrier and the toner carrying roller; and transferring a toner image formed by developing the electrostatic latent image to a transfer medium at a transfer position located on the downstream side of the development position in the movement direction of the latent image carrier.

According to the aspects of the invention, the toner carrying rollers carry both the contact toner which comes in direct contact with the surface of the toner carrying roller and the non-contact toner which does not come in direct contact with the surface of the toner carrying roller. In this way, it is possible to cause a lot of toner to fly between the latent image carrier and the toner carrying roller. Moreover, it is possible to improve development density. However, when the toner fly electric field becomes strong enough to guarantee an amount of toner to fly, toner is easily caused to fly. In particular, a problematic toner is the toner flying from the surface of the toner carrying roller facing the non-image region where the toner does not have to be attached originally. This toner should be finally returned to the surface of the toner carrying roller. This problem arises in that ground fogging occurs during reciprocal flying under the operation of the alternate electric field or the toner escapes and flies from the restriction of the electric field.

Here, the contact toner is strongly restricted to the toner carrying roller by the Coulomb force or the van der Waals force received from the surface of the toner carrying roller, but this restriction on the non-contact toner is relatively weak. Since the toner having the high charge amount in the toner carried on the surface of the toner carrying roller is particularly strongly drawn by the surface of the toner carrying roller, the toner having the high charge amount easily becomes the contact toner and the toner having the relatively low charge amount easily becomes the non-contact toner. That is, since the non-contact toner originally has the low charge amount and is carried at a position distant from the surface of the toner carrying roller, the non-contact toner is in a state where the detachment and flying from the toner carrying roller is very easily caused.

On the other hand, the inventors have obtained the following knowledge of the toner having the low charge amount. That is, under an environment where the toner easily receives a charge (for example, a positive charge in a negatively-charged toner) having the reverse polarity of the originally charged polarity, a charge reverse phenomenon that the toner is charged with a reverse polarity of the originally charged polarity upon receiving the charge is observed. According to this knowledge, the aspects of the invention are realized. In the following description, the originally charged polarity (for example, a negative polarity in the negatively-charged toner) of the toner to be used is referred to as "a regular polarity". A polarity (for example, a positive polarity in the negatively-charged toner) reverse to the regular polarity is referred to as "a reverse polarity".

In the aspects of the invention, the reverse polarity charge is supplied to the latent image carrier at the second charge position, after the latent image carrier is charged with the same polarity as the charged polarity of the toner, that is, the regular polarity, at the first charge position. In this way, the attachments unavoidably attached and remaining on the surface of the latent image carrier receive this charge to be charged with the reverse polarity after passing by the second charge position. Here, the attachments attached and remaining on the surface of the latent image carrier are mainly particles which are carried on the latent image carrier at the development position but are not transferred to a transfer medium at the transfer position. The attachments include toner having a minute charge amount, toner charged with the reverse polarity, and external additive particles which are detached from toner base particles and are electrically neutral. When the reverse polarity charge is applied to the attachments, the attachments (hereinafter, referred to as "reverse charge attachments") charged with the reverse polarity are thus distributed on the surface of the latent image carrier charged with the regular polarity in the rear of the second charge position.

The electrostatic latent image is formed on the surface of the latent image carrier and the electrostatic latent image is developed at the development position. However, as described above, both the contact toner and the non-contact toner are carried on the toner carrying roller and are caused to fly according to the aspects of the invention. Therefore, the toner having the low charge amount or the toner charged with the reverse polarity may be attached not to an area where the toner is originally attached but to the non-image region of the latent image carrier. By the method (for example, a method of applying an appropriate transfer bias to the transfer medium) used when the developed toner image is transferred to the transfer medium, the toner charged with the reverse polarity can not be transferred from the latent image carrier to the transfer medium.

On the other hand, since it is difficult to avoid the transfer to the transfer medium due to the low charge amount, the toner having the low charge amount may be transferred to the transfer medium, thereby causing the ground fogging in an image. This toner has to be originally returned to the surface of the toner carrying roller by an operation of the alternate electric field. However, since a force received from the electric field is also weak due to the low charge amount, this toner does not fly again but remains on the surface of the latent image carrier. Alternatively, this toner may avoid the restriction of the electric field and fly to the outside at the development position.

In order to solve this problem, the reverse charge attachments are distributed on the surface of the latent image carrier according to the aspects of the invention, as described above. In this way, the reverse charge attachments trap the toner having the low charge amount, or the charged polarity of the toner is forcibly changed to the reverse polarity by applying the reverse polarity charge. By trapping the toner having the low charge amount, the toner flying to the outside is effectively prevented. Moreover, the toner to which the reverse polarity charge is applied on the latent image carrier cannot be transferred to the transfer medium at the transfer position. In this way, it is possible to prevent the ground fogging in an image. This advantage is substantially effective in the non-image region on the surface of the latent image carrier where the toner should not be attached originally. In the image region where the toner is originally attached, the influence of the reverse charge attachments is small since a lot of toner charged with the regular polarity is attached.

According to the aspects of the invention, by carrying both the contact toner and the non-contact toner on the toner carrying roller, it is possible to increase the development density since the sufficient toner to cause flying is obtained even in the relatively low toner fly electric field. Since the toner fly electric field can be restrained to be low, the toner can be prevented from flying. In addition, between the non-image region on the latent image carrier and the surface of the toner carrying roller, the toner having the low charge amount is trapped by the reverse charge attachments or is not transferred to the transfer medium by applying the reverse polarity charge. Therefore, it is possible to prevent the toner from flying. Moreover, it is possible to prevent the ground fogging caused when the toner is attached to the non-image region on the surface of the latent image carrier.

According to the aspects of the invention, the transfer unit may apply the potential having the reverse polarity of the charged polarity of the toner to the transfer medium. In this way, since the toner attached to the surface of the latent image carrier and charged with the reverse polarity is prevented from being transferred to the transfer medium, it is possible to further prevent the ground fogging.

The transfer unit may include a charge supply unit which supplies a charge having the reverse polarity of the charged polarity of the toner toward the non-image region on the surface of the latent image carrier between the development position and the transfer position. With such a configuration, the toner developed after passing by the development position, attached to the non-image region of the surface of the latent image carrier, and having the low charge amount can be charged with the reverse polarity by applying a charge in the front of the transfer position. In this way, it is possible to more reliably prevent the ground fogging caused when the toner attached to the non-image region and having the low charge amount is transferred to the transfer medium at the transfer position.

Here, a potential which does not exceed discharge limitation in the image region on the latent image carrier and exceeds the discharge limitation in the non-image region on the latent image carrier may be applied to the charge supply unit. Then, the charge supply to the toner on the latent image carrier is achieved only in the non-image region and there is no influence on the image region. That is, since the charged polarity of only fogging toner attached on the non-image region can be changed without influencing an image, it is possible to reduce the ground fogging.

The second charge unit may be a scorotron charger including a corona wire to which a potential having the reverse polarity of the charged polarity of the toner is applied and a grid to which a potential having the same polarity as the charged polarity of the toner is applied. With such a configuration, it is possible to supply the reverse polarity charge to the surface of the latent image carrier in a non-contact manner. Therefore, it is possible to apply the reverse polarity charge to the attachments of the surface of the latent image carrier without influencing the surface potential of the latent image carrier. Moreover, it is possible to easily control the charge amount to be applied to the attachments on the surface of the latent image carrier.

The first charging unit may include a contact member to which a potential having the same polarity as the charged polarity of the toner is applied and which comes in contact with the latent image carrier. By the contact with the latent image carrier and the charging of the surface of the latent image carrier, it is possible to easily charge the surface of the latent image carrier with a uniform and desired potential.

The surface of the toner carrying roller which carries the toner may be made of a conductive material. With such a configuration, since an image force is strongly exerted between the toner carrying roller having the conductivity and the toner coming in contact with the toner carrying roller, a property that the contact toner barely flies is clearly evident. Therefore, it is difficult to simultaneously obtain the sufficient development density and prevent the ground fogging or the toner flying. According to the aspects of the invention, excellent advantages can be obtained.

In the toner carrying roller, concaves for carrying the toner may be formed on the cylindrical surface thereof and the depth of the concaves may be the double or more of a volume average diameter of the toner. With such a configuration, it is possible to carry the toner containing two or more layers on average. Accordingly, it is possible to carry a layer of the contact toner which comes in direct contact with the surface of the toner carrying roller and a layer of the non-contact toner which comes in contact with the layer of the contact toner and does not come in contact with the surface of the toner carrying roller.

By carrying the toner in the concaves, it is possible to more reliably carry the non-contact toner. Since the restrictive force of the non-contact toner to the toner carrying roller is relatively weak, the non-contact toner easily detaches and flies from the surface of the toner carrying roller. However, by carrying the toner in the state where the toner is received in the concaves, it is possible to prevent the toner from being detached.

In this case, the toner layer formed on the surface of the toner carrying roller other than the concaves may be regulated so that not more than one layer is formed, or the toner may be regulated so as not to be carried on the surface of the toner carrying roller other than the concaves. Since the toner carried in an area other than the concaves is exposed to the surface of the toner carrying roller, the toner is caused to fly easily. However, when the toner is brought into direct contact with the surface of the toner carrying roller by suppressing the toner so that not more than one layer is contained, the strong restriction makes it possible to prevent the toner from being detached from the surface of the toner carrying roller. In particular, when the toner is not carried on an area other than the concaves, this advantage becomes more effective.

In the aspects of the invention, the volume average diameter of the toner may be 5 μm or less. This toner having a small diameter can barely fly from the toner carrying roller since the Coulomb force or the van der Waals force is strongly exerted. Moreover, the strong toner fly electric field is required to obtain the sufficient development density. On the other hand, since the charge amount or the mass of the toner which has flown is small, this toner can easily avoid the restriction of the toner fly electric field and flies. Therefore, it is more difficult to simultaneously obtain the sufficient development density and prevent the ground fogging or the toner flying, compared to a case of the toner having a large diameter. By applying the aspects of the invention in this case, it is possible to obtain the sufficient development density, while preventing the ground fogging or the toner flying. That is, the aspects of the invention provide a technique for making the diameter of the toner small.

A cleaning unit may be further provided which removes some of the attachments, which are attached on the surface of the latent image carrier and charged with the reverse polarity of the charged polarity of the toner, on the downstream side of the transfer position, more preferably the downstream side of the first charge position, and the upstream side of the second charge position in the movement direction of the latent image carrier. The attachments charged with the reverse polarity are not transferred to the transfer medium, but the attachments are accumulated with the operations of the image forming apparatus. Therefore, when the attachments keep being accumulated, a lot of attachments are attached on the surface of the latent image carrier and thus affect the operations of the image forming apparatus. Accordingly, by removing some of the attachments on the upstream side of the second charge position, it is possible to prevent the attachments from having an adverse influence on the operations of the image forming apparatus.

The cleaning unit may be a brush roller which comes in contact with the surface of the latent image carrier. When the attachments are removed by the brush roller, the attachments having a relatively large particle diameter are easily removed, but the attachments having a small particle diameter are difficult to remove. As described above, in the attachments on the surface of the latent image carrier, the attachments having a large particle diameter are the toner particles and the attachments having a small particle diameter are external additives freed from the toner. Accordingly, when the brush roller is used as the cleaning unit, the toner remaining on the surface of the latent image carrier which may cause the image to be smeared is removed and the external additive particles which may not cause the image to be smeared selectively remain on the surface of the latent image carrier. In addition, by allowing the external additive particles to function as "reverse charge attachments", it is possible to better prevent the ground fogging. In particular, when the first charging unit which comes in contact with the surface of the latent image carrier is combined, the toner particles charged by the first charging unit can be effectively removed by the brush roller as the cleaning unit. Therefore, it is possible to more effectively prevent the ground fogging.

BRIEF DESCRIPTION OF THE DRAWINGS

The invention will be described with reference to the accompanying drawings, wherein like numbers reference like elements.

FIG. 5 is a diagram illustrating a relation between a charge state and a development feature of the toner.

DESCRIPTION OF EXEMPLARY EMBODIMENTS

Figure 1:
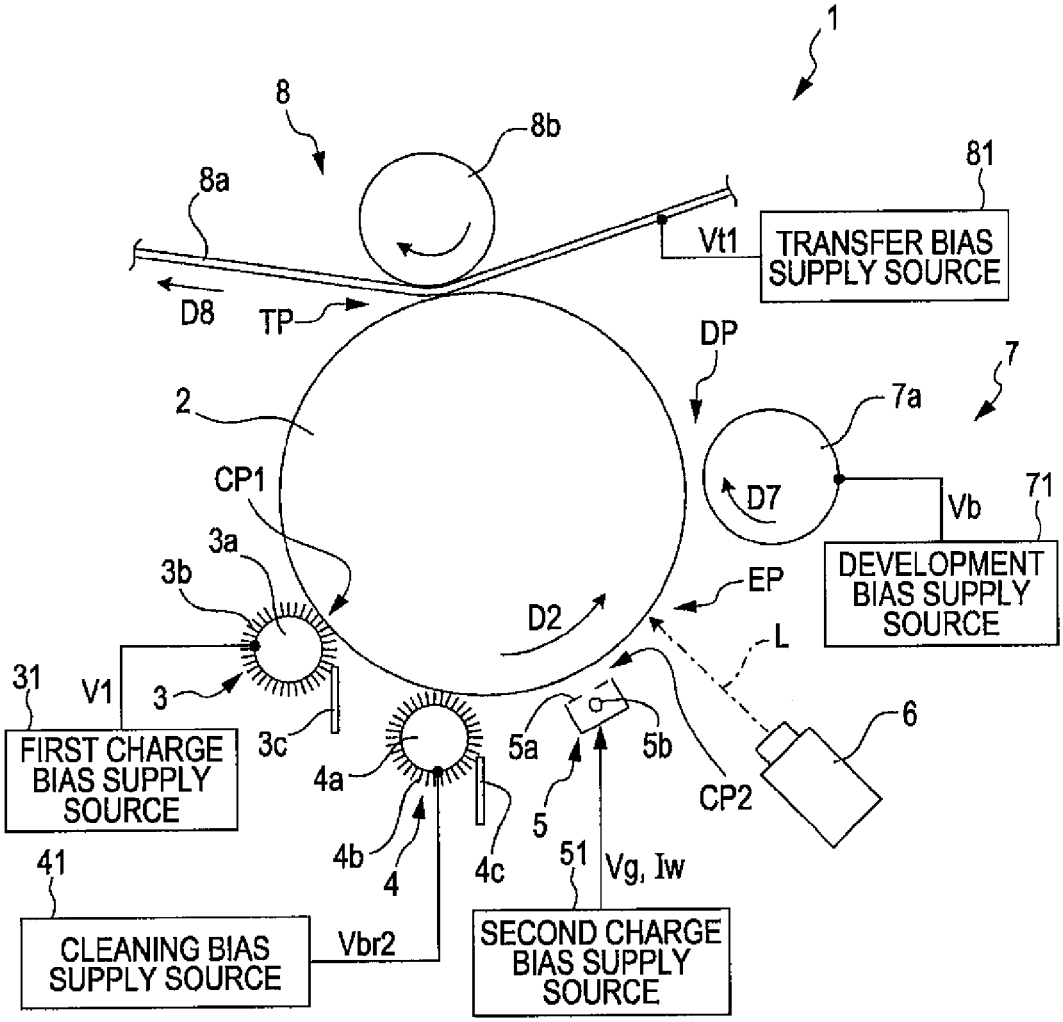
FIG. 1 is a diagram illustrating the general configuration of an image forming apparatus according to a first embodiment of the invention.
Figure 2:
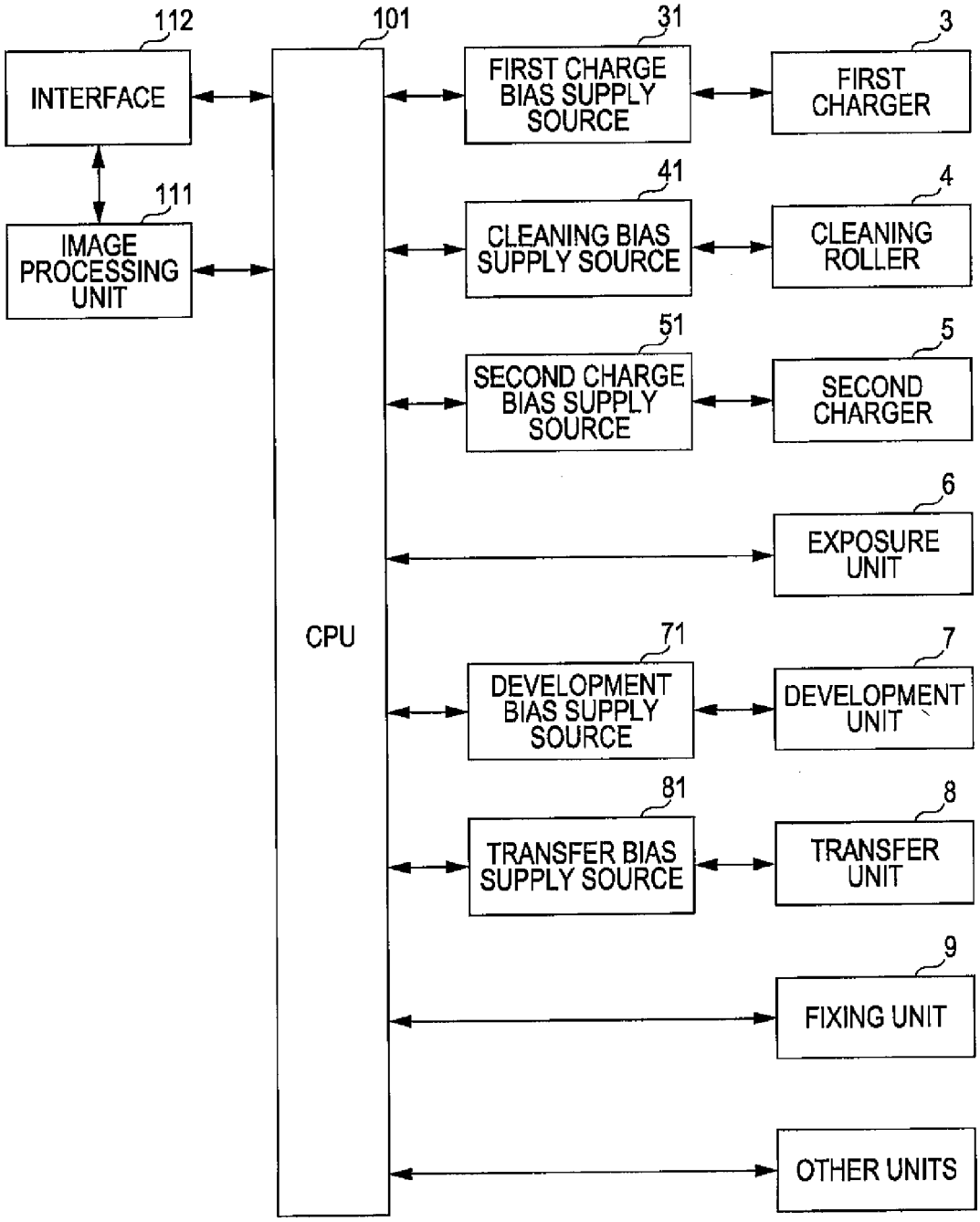
FIG. 2 is a block diagram illustrating the electric configuration of the image forming apparatus shown in FIG. 1.

FIG. 1 is a diagram schematically illustrating the general configuration of an image forming apparatus according to a first embodiment of the invention. FIG. 2 is a block diagram illustrating the electric configuration of the image forming apparatus shown in FIG. 1. An image forming apparatus 1 according to this embodiment forms an image using non-magnetic monocomponent negatively-charged toner. Of course, the image forming apparatus 1 may form an image using positively-charged toner. In the following description, the image forming apparatus 1 uses the negatively-charged toner. However, when the image forming apparatus 1 uses the positively-charged toner, the potential charged by each unit which is described below has a reverse polarity. In addition, toner includes toner base particles and external additives added to the toner base particles. However, in the following description, the toner base particles are simply called toner.

As shown in FIG. 1, the image forming apparatus 1 according to this embodiment includes a photosensitive member 2. The photosensitive member 2 includes a photosensitive drum. As in a known photosensitive drum, a photosensitive layer with a predetermined thickness is formed on the outer circumferential surface of a cylindrical metallic tube. A conductive drum made of aluminum, for example is used in the metallic tube of the photosensitive member 2. A known organic photoreceptor is used in the photosensitive layer.

A first charger 3 as a roller charging unit, a cleaning roller 4, a second charger 5 as a scorotron charger, an exposure unit 6, a development unit 7, and a transfer unit 8 are arranged around the photosensitive member 2 in this order in a rotational direction D2 (counterclockwise in FIG. 1) of the photosensitive member 2.

The first charger 3 includes a first brush roller 3*a* provided to be rotatable. The first brush roller 3*a* includes several brushes 3*b*. The brushes 3*b* are disposed to be close to or come in contact with the surface of the photosensitive member 2. The first brush roller 3*a* rotates in a forward direction (a direction in which the velocity in a tangential direction of the rotation of the photosensitive member 2 is the same as the velocity in a tangential direction of the rotation of the brushes 3*b* in a contact portion between the photosensitive member 2 and the brushes 3*b*) of the photosensitive member 2 or in a backward direction (in a direction in which the velocity in the tangential direction of the rotation of the photosensitive member 2 is reverse to the velocity in the tangential direction of the rotation of the brushes 3*b*) of the photosensitive member 2.

A known charging brush roller used in a known technique may be used as the first brush roller 3*a*. As for the brushes 3*b* of the first brush roller 3*a*, a material is 6-nylon, fitness is 220 T/96 F, density is 240 kf/inch$^2$, original yarn resistance is 7.1 Log Ω, and pile length is 5 mm. In addition, the length of the first brush roller 3*a* in an axial direction of the photosensitive member 2 is 300 mm. A brush roller made by TOEISANGYO Co., Ltd may be used as the first brush roller 3*a*.

A roller charging bias V1, which exceeds a discharge starting voltage for the surface potential of the photosensitive member 2 and serves as direct current (DC) having one polarity of relatively strong positive and negative polarities, is applied from a first charge bias supply source 31 to the first brush roller 3*a*. Therefore, an electric field is generated between the photosensitive member 2 and the first brush roller 3*a* and the surface of the photosensitive member 2 after the end of a transfer process is charged with a relatively strong potential having the same polarity as that of the roller charging bias V1. As for the transferred toner remaining on the surface of the photosensitive member 2 and the external additives separated from the toner, the charging polarity thereof is not positive or negative (most of the remaining transferred toner and the external additives are charged with 0 V (no charge) or positively charged). However, the remaining transferred toner and the external additives charged relatively strongly with a polarity reverse to that of the roller charging bias V1 in the remaining transferred toner and the external additives are electrostatically drawn to the first brush roller 3*a* to be attached to the brushes 3*b*.

The remaining transferred toner and the external additives which are not removed from the photosensitive member 2 by the first brush roller 3*a* are simultaneously charged with 0 V or the same polarity as the charged polarity of the photosensitive member 2 when the photosensitive member 2 is charged. At this time, even when the remaining transferred toner and the external additives are charged with either the positive polarity or the negative polarity, the remaining transferred toner and the external additives are charged with 0 V without fail or the same polarity of the charged polarity of the photosensitive member 2 due to the small absolute value of the potential thereof. In addition, another roller charger such as a charge rubber roller other than the brush roller 3*a* may be used in the first charger 3.

The first charger 3 includes a cleaning blade 3*c* which comes in contact with the brushes 3*b* of the first brush roller 3*a*. The cleaning blade 3*c* removes and collects the remaining transferred toner and the external additives attached to the brushes 3*b*. A known cleaning blade may be used as the cleaning blade 3*c*.

The cleaning roller 4 includes a second brush roller 4*a* formed so as to be rotatable. The second brush roller 4*a* has several brushes 4*b*. The brushes 4*b* are disposed to come in contact with the surface of the photosensitive member 2. The second brush roller 4*a* rotates in a forward direction (a direction in which the velocity in the tangential direction of the rotation of the photosensitive member 2 is the same as the velocity in a tangential direction of the rotation of the brushes 4*b* in a contact portion between the photosensitive member 2 and the brushes 4*b*) of the photosensitive member 2 or in a backward direction (in a direction in which the velocity in the tangential direction of the rotation of the photosensitive member 2 is reverse to the velocity in the tangential direction of the rotation of the brushes 4*b*) of the photosensitive member 2. The same brush roller as the above-described first brush roller 3*a* may be used as the second brush roller 4*a*.

A cleaning bias Vbr2 of direct current (DC) which draws the external additives and the toner charged in the first charger 3 is applied to the second brush roller 4*a*. In this case, the cleaning bias Vbr2 is set such that an electric field to be generated in a direction reverse to of that of the electric field generated between the photosensitive member 2 and the first brush roller 3*a* is formed between the photosensitive member 2 and the second brush roller 4*a*. In this way, the remaining transferred toner and the external additives, which are charged relatively strongly with the polarity reverse to that of the remaining transferred toner and the external additives drawn by the first brush roller 3*a* in the remaining transferred toner and the external additives passing through the roller charger 3, on the photosensitive member 2 are electrostatically drawn to the second brush roller 4*a*. Then, the drawn toner and external additives are attached to the brushes 4*b*. In addition, another conductive cleaning roller such as a conductive rubber roller other than the brush roller may be used in the cleaning roller 4.

The cleaning roller 4 includes a cleaning blade 4*c* coming in contact with the brushes 4*b* of the second brush roller 4*a*. The cleaning blade 4*c* removes and collects the remaining transferred toner and the external additives attached to the brushes 4*b*. A known cleaning blade may be used as the cleaning blade 4*c*.

The second charger 5 does not come in contact with the surface of the photosensitive member 2. A known corona charger may be used as the second charger 5. When a scorotron charger is used in the corona charger, a positive wire current Iw flows in a charge wire 5*b* of the scorotron charger and a grid charge bias Vg of a negative direction current (DC) is applied to a grid 5*a*. When the photosensitive member 2 is charged through corona charge of the polarity (positive polarity) reverse to that of the toner by the second charger 5, the potential of the surface of the photosensitive member 2 is lowered and averaged and the potential of the surface of the photosensitive member is set to a potential Vo set upon forming an image. At this time, an electric charge with the polarity (positive polarity) reverse to that of the toner is applied to the remaining transferred toner and the external additives passing through the second brush roller 4*a* to be charged with that polarity.

The exposure unit 6 forms an electrostatic latent image corresponding to an image signal by exposing the surface of the photosensitive member 2 by the use of a light beam L in accordance with the image signal supplied from an external apparatus. More specifically, when the image signal is supplied from the external apparatus such as a host computer for generating the image signal through an interface 112, as shown in FIG. 2, an image processing unit 111 performs a predetermined process on the image signal. The image signal is supplied to and received from the exposure unit 6 through a CPU 101 for controlling an operation of the image forming apparatus as a whole. The exposure unit 6 emits the light beam L onto the surface of the photosensitive member 2 in accordance with the image signal to expose the surface of the photosensitive member 2. Then, the electric charge in a surface area (exposed region) of the exposed photosensitive member 2 is neutralized and turned into a surface potential VL different from that of a surface area (non-exposed region) which is not subjected to the exposure. In this way, the electrostatic latent image corresponding to the image signal is formed on the photosensitive member 2.

The toner is applied from the development unit 7 to the electrostatic latent image formed in this manner, and then the electrostatic latent image is developed by the toner. The development unit 7 of the image forming apparatus 1 according to this embodiment is a non-contact development type developer in which the development roller 7*a* des not come in contact with the photosensitive member 2. The development roller 7*a* is disposed to be opposed to the photosensitive member 2 with a predetermined gap therebetween and driven rotatably in an arrow direction D7 of FIG. 1. A predetermined development bias Vb is applied from a development bias supply source 71 to the development roller 7*a*. The configuration of the development unit 7 is described in detail below. A known non-contact developer may be used.

The transfer unit 8 is an endless-shaped belt which is capable of carrying a toner image on the surface thereof. The transfer unit 8 includes an intermediate transfer belt 8*a* which goes around in an arrow direction D8 of FIG. 1. The intermediate transfer belt 8*a* comes in contact with the surface of the photosensitive member 2 by a backup roller 8*b* disposed close to the photosensitive member 2. A transfer bias Vt1 having a polarity reverse to the charged polarity of the toner is applied from a transfer bias supply source 81 to the intermediate transfer belt 8*a*. Then, the toner image developed on the photosensitive member 2 is subjected to transfer (primary transfer) to be formed on the intermediate transfer belt 8*a*. The toner image transferred on the intermediate transfer belt 8*a* is also subjected to secondary transfer to be formed on a print sheet (not shown) Then, the toner image is permanently fixed on the print sheet by a fixing unit 9 and output.

In the following description, a position where the photosensitive member 2 is opposed to the first charger 3 is called a first charge position CP1. A position where the photosensitive member 2 is opposed to the second charger 5 is called a second charge position CP2. A position where the light beam L from the exposure unit 6 is emitted to the surface of the photosensitive member 2 is called an exposure position EP. A position where the photosensitive member 2 is opposed to the development roller 7*a* is called a development position DP. A position where the photosensitive member 2 comes in contact with the intermediate transfer belt 8*a* is called a transfer position TP.

Next, the toner used in the image forming apparatus having the above-described configuration will be described. The image forming apparatus according to this embodiment develops the electrostatic latent image using negatively-charged non-magnetic monocomponent toner. Hereinafter, the negative polarity serving as an original polarity of the toner is called "regular polarity" and the positive polarity which is reverse to the regular polarity is called "reverse polarity".

Figure 3:
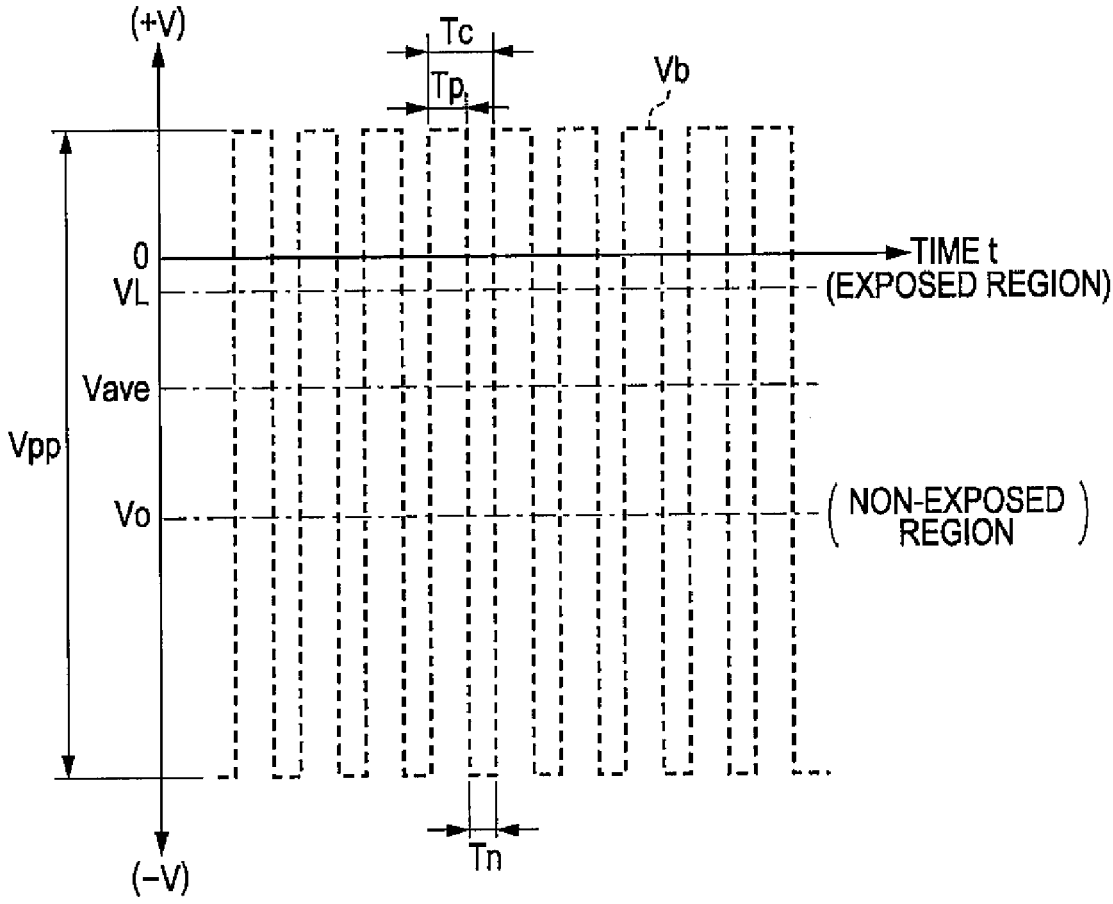
FIG. 3 is a diagram illustrating a potential relation between units according to the embodiment.

FIG. 3 is a diagram illustrating a potential relation between the potentials to be applied to units according to this embodiment. An example of values of the potentials or currents of the units is shown as follows, but this embodiment is not limited to these values:

First Charge Bias V1=−1300 V;

Cleaning Bias Vbr2=−500 V;

Scoroton Grid Voltage Vg=−500 V;

Charge Wire Current Iw=+200 μA;

Weighted Average Voltage Vave of Development Bias Vb=−200 V;

Amplitude (voltage between peaks) Vpp of Development Bias Vb=1300 V; and

Transfer Bias Vt1=+400 V.

A period in which the potential is inclined to a positive side and a period in which the potential is inclined to a negative side in a repeat period Tc of an alternating-current component Vac of the development bias Vb are denoted by Tp and Tn, respectively. A waveform duty WD of the development bias Vb is defined by the following expression:

$$WD=Tp/(Tp+Tn)=Tp/Tc.$$

In this embodiment, as shown in FIG. 3, the bias waveform is set such that a relation of Tp>Tn is satisfied, that is, the waveform duty WD is larger than 50%. That is because the toner attached to the non-exposed region of the photosensitive member 2, that is, an area where the toner does not have to be attached originally, is effectively returned to the development roller 7*a* by allowing a period in which the toner flies from the photosensitive member 2 to the development roller 7*a* to be longer than a period opposite to this period.

Figure 4:
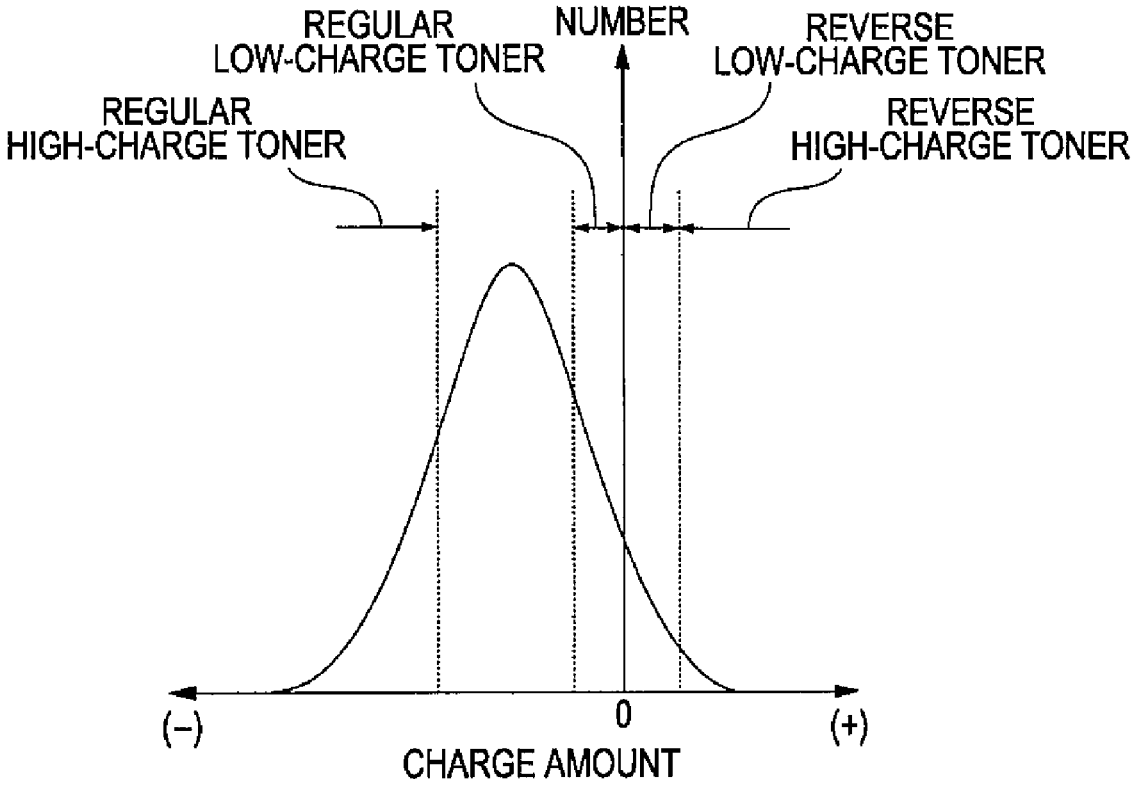
FIG. 4 is a diagram illustrating a charge distribution of toner.

FIG. 4 is a diagram illustrating a charge distribution of the toner. FIG. 5 is a diagram illustrating a relation between a charge state and a development feature of the toner. In this embodiment, the negatively charged toner is used. However, as shown in FIG. 4, the charge distribution mainly becomes a normal distribution, since there is an irregularity in the charge feature of the toner. The toner includes toner which is not charged or toner which is charged with the reverse polarity (in this case, the positive polarity). The charge state of the toner having a large deviation from a median value Q0 in the charge distribution is classified as follows:

(1) regular high-charge toner which is charged with the regular polarity and has a high charge amount;

(2) regular low-charge toner which is charged with the regular polarity and which has a low charge amount or is rarely charged;

(3) reverse low-charge toner which is charged with the reverse polarity and which has a low charge amount or is rarely charged; and (4) reverse high-charge toner which is charged with the reverse polarity and has a high charge amount.

The numerical value range of "the high charge" and "the low charge" is set conveniently and relatively, and the invention is not limited thereto. FIG. 5 shows an experimental evaluation representing how the toner contributes to the development feature and the result. As evaluation items of the development feature, four items of dot reproducibility, solid reproducibility, flying, and ground fogging were used.

Here, "the dot reproducibility" is an indicator representing an ability to reproduce dots with a high contact in an image where an area of isolated dots or fine lines is small. Since in the toner charged with the regular polarity, the toner (the regular high-charge toner) having a high charge amount is sensitive to the potential profile of the electrostatic latent image on the photosensitive member 2, the isolated dots and the fine lines can be formed with a high contrast. In contrast, even in the toner charged with the regular polarity, the toner (the regular low-charge toner) having a low charge amount is not suitable for expressing a minute variation in the potential as a difference in the density. In fact, when an image is formed using only the toner having the low charge amount, it is known that an image with fine lines becomes vague. The toner charged with the reverse polarity has nothing to do with the dot reproducibility. That is, in terms of the dot reproducibility, the regular high-charge toner is the most excellent and the regular low-charge toner is the next most excellent.

Next, "the solid reproducibility" is an indicator representing whether an image such as a solid image having a relatively broad area can be reproduced without density irregularity in contrast to the dot reproducibility. As described above, the regular high-charge toner is sensitive to the variation in the potential on the photosensitive member 2. Therefore, when a slight variation in the potential causes a difference in density, the density irregularity may occur. In contrast, this density irregularity hardly occurs in the regular low-charge toner having a lower sensitivity to the potential variation on the photosensitive member 2. Here, the toner charged with the reverse polarity has also nothing to do with the solid reproducibility. That is, in terms of the solid reproducibility, the regular low-charge toner is the most excellent and the regular high-charge toner is the next most excellent.

"The flying" is an indicator representing how much the toner flies to the vicinity where the development bias Vb is applied to the development roller 7*a*. By applying an alternate voltage serving as the development bias Vb to the development roller 7*a*, both the toner charged with the regular polarity and the toner charged with the reverse polarity are caused to fly from the development roller 7*a*. In either charged polarity, the toner flying to the vicinity is small, since the toner having the high charge amount is strongly restricted by the attachment force to the photosensitive member 2 or the development roller 7*a* or the electric field. In contrast, since the toner having the low charge amount is not strongly attached or restricted, the toner escapes from the restriction of the electric field and thus is caused to fly easily. That is, in terms of the toner flying, the regular high-charge toner and the reverse high-charge toner are the most excellent (that is, the flying is small) and the regular low-charge toner and the reverse low-charge toner are the next most excellent.

"The ground fogging" is a phenomenon that the toner becomes attached to a non-exposed region of the photosensitive member 2 where the toner does not have to be attached originally. Since the toner charged with the reverse polarity is strongly drawn to the non-exposed region of the photosensitive member 2 to which the high potential of the regular polarity is applied, a lot of reverse polarity toner is attached to the non-exposed region. In this case, since the positive transfer bias Vt1 is applied to the intermediate transfer belt 8*a*, there is a slight possibility that the reverse polarity toner attached to the photosensitive member 2 in this manner is transferred to the intermediate transfer belt 8*a* at the transfer position TP.

On the other hand, a problem rarely arises in the toner having the low charge amount in the regular polarity toner, since the toner having the low charge amount is weak in an attachment force to the non-exposed region and can be returned to the development roller 7*a* by the alternate electric field. In contrast, there is a high possibility that the regular high-charge toner remains on the photosensitive member 2 after passing the development position DP, since a strong electric field has to be exerted to separate the regular high-charge toner from the non-exposed region of the photosensitive member 2 once the regular high-charge toner is attached to the non-exposed region. Since the toner is charged with the regular polarity, the toner is transferred to the intermediate transfer belt 8*a* at the transfer position TP and thus remains on a final image, thereby deteriorating the image quality.

It is generally known that the ground fogging phenomenon occurs when the toner charged with the polarity reverse to the originally charged polarity (in this embodiment, the negative polarity) or the toner having a very low charge amount is attached to the non-exposed region. However, it can be known that the regular high-charge toner also has a considerable influence on the ground fogging. That is, in terms of the ground fogging, the regular low-charge toner is the most excellent. The ground fogging occurs to a considerable extent in the reverse polarity toner, but the transfer to the intermediate transfer belt 8*a* is difficult. On the other hand, the regular high-charge toner has a problem in that the regular high-charge toner remains in the final image even though the absolute fogging is small.

Accordingly, in order to form various images such as an image where isolated dots or fine lines are mainly formed and a solid image with a high quality, it is preferable that both the regular high-charge toner and the regular low-charge toner are appropriately mixed. On the other hand, in order to restrain the toner from flying from the development roller 7*a* to the vicinity thereof, it is necessary to control the behavior of the regular low-charge toner and the reverse low-charge toner. In addition, in order to prevent the ground fogging from the non-exposed region, it is necessary to control the behavior of the regular high-charge toner.

In this embodiment, in order to carry two or more toner layers on the surface of the development roller 7*a*, the regular high-charge toner and the regular low-charge toner are positively transported to the development position DP. When two or more toner layers are carried in the development roller 7*a*, the toner (hereinafter, referred to as "contact toner") which comes in direct contact with the surface of the development roller 7*a* and the non-contact toner which comes in contact with the contact toner but does not come in direct contact with the surface of the development roller 7*a* exist on the surface of the development roller 7*a*.

According to the study of the inventors, the toner used as the contact toner generally has a tendency to have the high charge amount and the toner used as the non-contact toner generally has a tendency to have the low charge amount. It is considered that that is because the toner having the low charge amount is pushed by the toner having the high charge amount while the toner having the high charge amount is drawn to the development roller by a stronger force. In fact, it was configured so that a difference between the behavior of the contact toner and the behavior of the non-contact toner is considerable when the surface of the development roller is made of a conductive material such as metal. It is considered that this is because a strong image force is exerted between the material having the high conductivity and the toner having the high charge amount.

In this way, in this embodiment, a sufficient development density and a high image quality can be obtained by carrying the two or more toner layers on the surface of the development roller 7*a*, transporting both the regular high-charge toner and the regular low-charge toner to the development position DP, and contributing the both to the development operation. Moreover, in this embodiment, the flying of the lower charge toner is restrained in the following manner.

Figure 6:
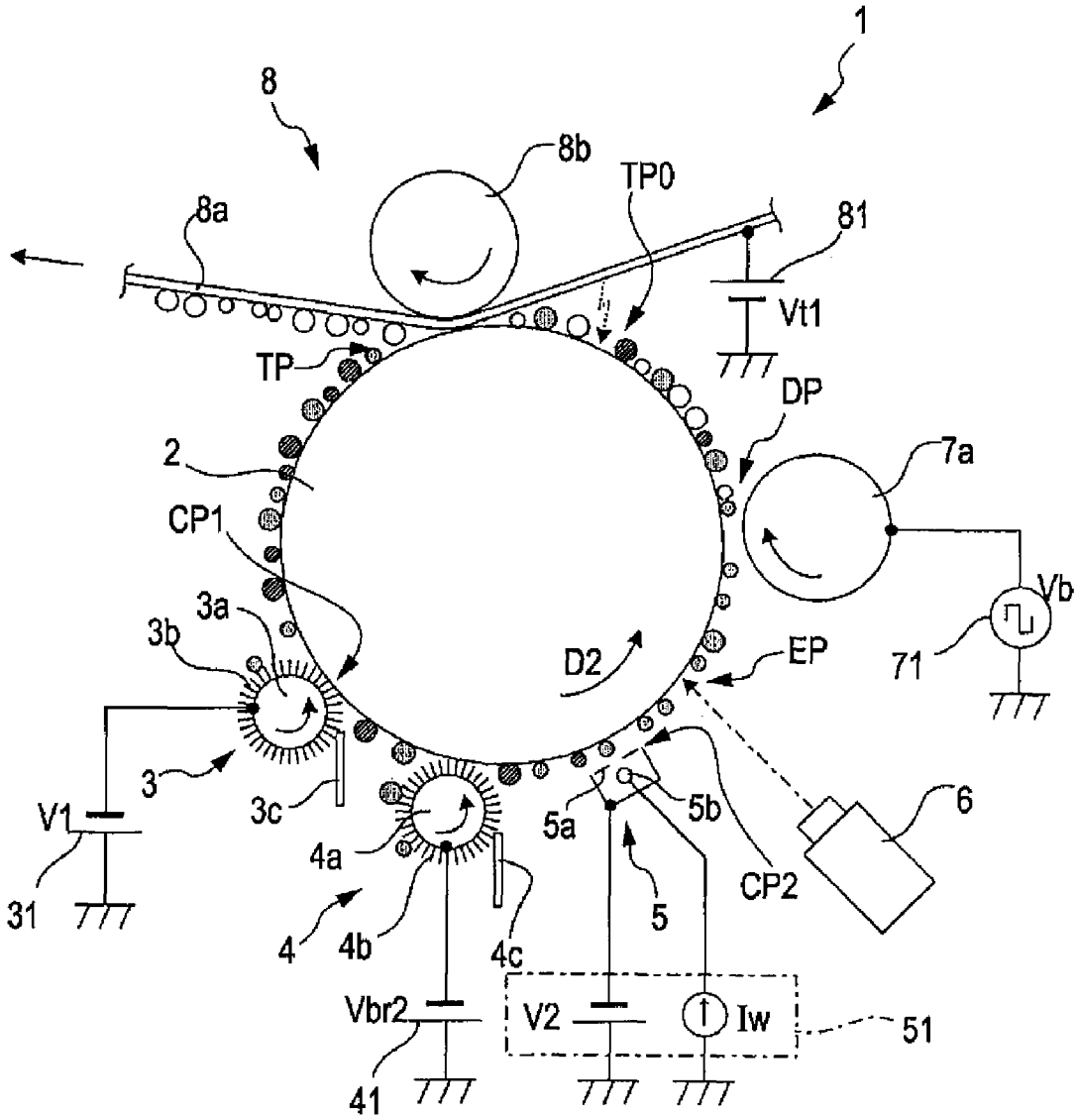
FIG. 6 is a diagram schematically illustrating the behavior of the toner on a photosensitive member according to the embodiment.

FIG. 6 is a diagram schematically illustrating the behavior of the toner on the photosensitive member according to this embodiment. Toner particles having different charge amounts or different polarities or external additive particles are attached onto the surface of the photosensitive member 2 passing the development position DP. In addition, the particles charged with the regular polarity (the negative polarity) are transferred to the intermediate transfer belt 8*a* by an operation of the transfer bias Vt1 with the reverse polarity (the positive polarity). Accordingly, on the downstream of the transfer position TP in the rotational direction D2 of the photosensitive member 2 shown in FIG. 6, the toner charged with no charge or the reverse charge remains on the surface of the photosensitive member 2.

The same polarity as the charged polarity of the toner, that is, the relatively large negative potential V1 serving as the regular polarity, is applied to the first charger 3. The photosensitive member 2 is charged with the negative potential at the first charge position CP1. The smaller negative potential Vbr2 is applied to the cleaning roller 4. Attachments, such as the external additive particles or the toner particles charged with a polarity reverse to the charged polarity of the toner, attached to the surface of the photosensitive member 2 are attached to the brushes 4*b* to be removed. At this time, since the diameter of the toner particles is relatively large, removal efficiency is high. However, some of the smaller external additive particles sneak from the brushes 4*b* and remain on the photosensitive member 2. Moreover, the particles having a very low charge amount are completely removed in some cases. As a consequence, in the front of the second charge position CP2, the particles remaining on the photosensitive member 2 mainly include the particles having a low charge amount even though the particles have no charge or the reverse polarity.

An experiment carried out by the inventors reveals that the toner particles or the external additive particles having no charge or the low charge amount can be easily charged with the reverse polarity when the toner particles and the external additive particles are put under an environment of easily receiving the charge with the reverse polarity. In this embodiment, since corona discharge of the reverse polarity is performed at the second charge position CP2, the non-charge particles or the low charge particles attached onto the photosensitive member 2 receive the charge of the reverse polarity and are charged with the reverse polarity. As a consequence, on the downstream side of the second charge position CP2, most of the particles attached onto the photosensitive member 2 become the particles charged with the reverse polarity. That is, in this embodiment, the surface of the photosensitive member 2 is charged with the regular polarity before the photosensitive member 2 arrives at the development position DP, and attachments (hereinafter, referred to as "reverse polarity attachments") charged with the reverse polarity are present on the surface of the photosensitive member 2 in a distributed state.

Then, the light beam L is emitted onto the photosensitive member 2 at the exposure position EP to form an electrostatic latent image. The electrostatic latent image is transported to the development position DP. At the development position DP, the toner particles and the external additive particles having various different charge amounts and charge polarities are caused to fly, but the particles having the high charge amount are selectively attached onto the development roller 7*a* or the surface of the photosensitive member 2 due to the strength of the electrostatic attachment force. Here, the regular high-charge toner is moved mainly to the exposed region with the low potential in the surface of the photosensitive member 2 to form the electrostatic latent image or remain on the surface of the development roller 7*a*. In addition, the reverse high-charge toner is attached mainly to the non-exposed region with the high negative potential in the surface of the photosensitive member 2 or remains on the surface of the development roller 7*a*.

On the other hand, since the particles having the low charge amount are weak in the electrostatic attachment force, no attachment place is clearly determined. For this reason, these particles may not be attached to either the development roller 7*a* or the photosensitive member 2 but rather fly to the vicinity thereof. In this embodiment, however, the reverse polarity attachments are in the distributed state on the surface of the photosensitive member 2 arriving at the development position DP. Moreover, a local electric field for drawing the particles charged with the regular polarity is formed in the vicinity of the reverse polarity attachments. Therefore, the reverse polarity attachments have in particular a function of drawing and trapping (capturing) the particles with the low charge amount among the particles flying at the development position DP. In this way, since the particles having the low charge amount and being trapped on the photosensitive member 2 do not fly, the flying to the vicinity is prevented.

A large amount of toner charged with the regular polarity is attached to the exposed region in the surface of the photosensitive member 2. Therefore, it is considered that the charge of the reverse polarity attachments is completely removed in the exposed region. Whether the trapped toner exists does not influence the image quality. On the other hand, since the regular high-charge toner is not attached easily to the non-exposed region, it is considered that the above-described trapping effect is very effective. However, when the trapped toner is transferred to the intermediate transfer belt 8*a*, the ground fogging occurs and thus the image may be smeared.

In order to solve this problem, in this embodiment, the transfer bias Vt1 (in the above-mentioned example, +400 V) with the relatively high reverse polarity is applied in the intermediate transfer belt 8*a*. That is, by applying a high reverse polarity potential to the intermediate transfer belt 8*a*, a potential difference between the surface of the photosensitive member 2 with the regular polarity potential and the intermediate transfer belt 8*a* with the reverse polarity potential become large at a position TP0 immediately before the transfer position TP in the rotational direction D2 of the photosensitive member 2. As shown in FIG. 3, the potential difference between the non-exposed region of the photosensitive member 2 and the intermediate transfer belt 8*a* is particularly large. In this embodiment, the value of the transfer bias Vt1 is set such that no discharge is made (a discharge limitation is not exceeded) between the exposed region of the photosensitive member 2 and the intermediate transfer belt 8*a* and the discharge is made (the discharge limitation is exceeded) between the non-exposed region of the photosensitive member 2 and the intermediate transfer belt 8*a*.

In this way, before the transfer position TP, the discharge is made between the non-exposed region of the photosensitive member 2 and the intermediate transfer belt 8*a*. This discharge operates such that the reverse polarity charge is applied to the regular charge toner (and the external additives) trapped in the non-exposed region and the charged polarity is turned into the reverse polarity. That is, the regular charge toner trapped in the non-exposed region is switched to the reverse polarity toner by this discharge. In this way, the trapped toner is reliably prevented from being transferred to the intermediate transfer belt 8*a* at the transfer position TP. Moreover, since the potential of the non-exposed region of the photosensitive member 2 is lowered by this discharge, the discharge is prevented from arising on the surface of the photosensitive member 2 after the photosensitive member 2 passes by the transfer position TP.

However, as for the regular high-charge toner attached to the non-exposed region of the photosensitive member 2, it is not easy to apply the reverse polarity to the extent of reversing the polarity. Therefore, in this toner, it is important for this toner not to be attached to the non-exposed region. In this embodiment, this goal is realized by appropriately setting the amplitude Vpp of the development bias Vb. In the following description, the minimum magnitude of an electric field necessary to cause the toner to fly in the surface of the development roller 7*a* is called "the magnitude of a fly start electric field".

Figures 7A, 7B:
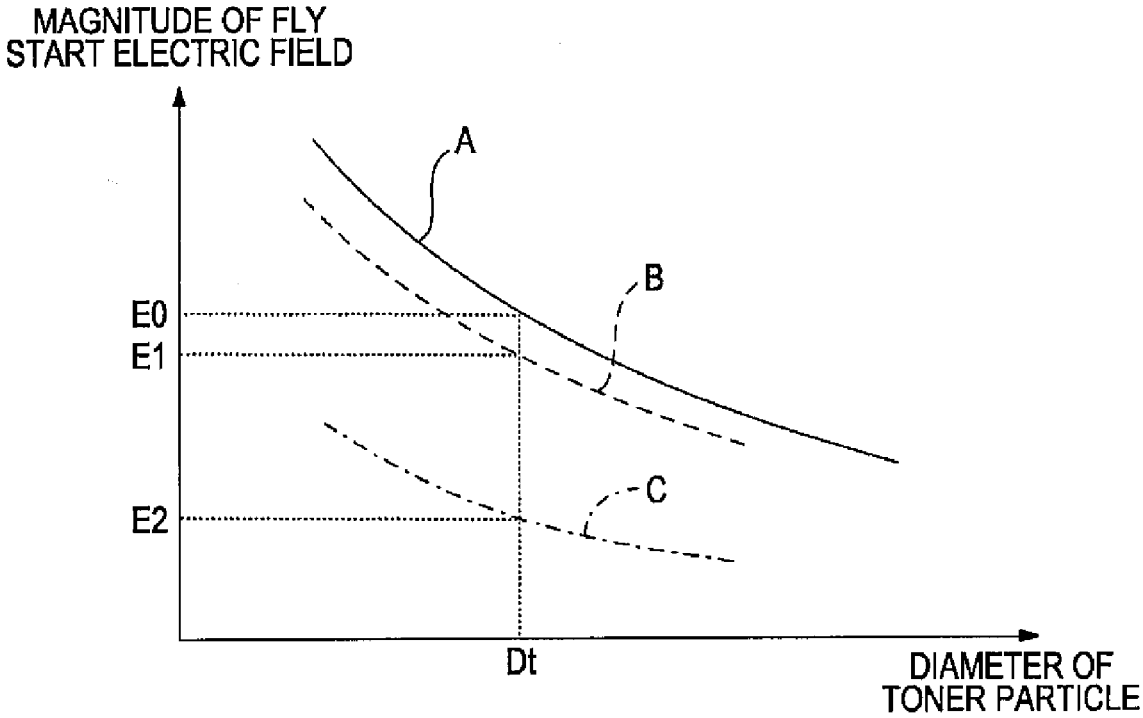
FIGS. 7A and 7B are diagrams illustrating a measured result of a relation between the diameter of a toner particle and the magnitude of a fly start electric field.

FIGS. 7A and 7B are diagrams illustrating the measured result of a relation between the diameter of the toner particle and the magnitude of the fly start electric field. More specifically, FIG. 7A is the diagram illustrating a variation of the magnitude of the fly start electric field with respect to the diameter of the toner particle. FIG. 7B is the diagram illustrating an example of actually-measured values of the magnitude of the fly start electric field. A curve A indicated by a full line in FIG. 7A represents the actually-measured result of the magnitude of the fly start electric field (hereinafter, "the magnitude of a mono-layer toner fly start electric field") when not more than one layer is carried on the surface of the development roller 7*a*. The curve A shows that as the diameter of the toner particle is smaller, the magnitude of the fly start electric field becomes larger. It is considered that this is because the attachment force to the surface of the development roller 7*a* becomes larger since the surface area or the charge amount per mass becomes larger as the diameter of the toner particle is smaller.

A curve B indicated by a dashed line and a curve C indicated by a one-dot chain line show the actually-measured results obtained when a toner containing two layers is carried on the surface of the development roller 7*a*. When the toner containing the two toner layers or, more precisely, the two or more toner layers are carried on the surface of the development roller 7*a*, not all of the toner come in contact with the surface of the development roller 7*a*, but some (the non-contact toner) of the toner come in contact with the toner (the contact toner) coming in contact with the surface of the development roller 7*a*, and thus are indirectly carried on the development roller 7*a*. According to the knowledge of the inventors, it can be confirmed that a behavioral difference between the two kinds of toner contributes considerably to the features of the development operation.

The curve B shown in FIG. 7A represents the magnitude of a fly start electric field for the contact toner (hereinafter, referred to as "the magnitude of a contact toner fly start electric field"). The curve C represents the magnitude of a fly start electric field for the non-contact toner (hereinafter, referred to as "the magnitude of a non-contact toner fly start electric field").

The curves B and C of FIG. 7A show that the magnitude of the fly start electric field becomes higher as the diameter of the toner particles is smaller even when the toner contains two layers. The magnitude of the contact toner fly start electric field (the curve B) is lower than the magnitude of the mono-layer toner fly start electric field (the curve A). The magnitude of the non-contact toner fly start electric field (the curve C) is further lower than the magnitude of the contact toner fly start electric field (the curve B). In the following description, in the toner having volume-average particle diameter of a certain value Dt, the magnitude of the mono-layer toner fly electric field, the magnitude of the contact toner fly start electric field, and the magnitude of the non-contact toner fly start electric field are denoted by E0, E1, and E2, respectively.

As actually-measured numerical values, FIG. 7B shows the actually-measured results of the magnitude E0 of the mono-layer toner fly start electric field, the magnitude E1 of the contact toner fly start electric field, and the magnitude E2 of the non-contact toner fly start electric field which are measured using the toner having the volume average diameter Dt of 4.5 μm. The reason that the results were obtained is as follows.

As described above, the toner is strongly restricted due to the direct contact with the surface of the development roller 7*a*. Therefore, when the strong electric field E0 is not applied, the toner does not fly. When the toner carried on the surface of the development roller contains two or more layers, the restrictive force from the surface of the development roller is weak for the non-contact toner which does not directly come in contact with the surface of the development roller. Accordingly, the magnitude E2 of the electric field (the magnitude of the non-contact toner fly start electric field) necessary to cause the non-contact roller to fly from the development roller may be set so as to be considerably lower than the magnitude E0 of the fly start electric field obtained when the toner contains one layer.

Alternatively, even when the toner carried on the surface of the development roller contains two or more layers, the toner (the contact toner) directly coming in contact with the surface of the development roller receives the same restrictive force as that of the toner obtained when the toner contains one layer. Accordingly, it is simply considered that the contact toner does not fly unless an electric field having the same magnitude as the magnitude E0 of the mono-layer toner fly start electric field is applied.

In this case, however, there is the non-contact toner which is caused to fly by an electric field weaker than that in the vicinity of the surface of the development roller, unlike the case where the toner originally contains one layer. The toner flying in this manner is accelerated while being reciprocated by an alternate electric field. As a consequence, this toner receives a sufficient kinetic energy and then collides against the contact toner on the development roller to send off the contact toner and thus fly the contact toner. That is, due to the fact that the non-contact toner starts to fly under the weaker electric field, the contact toner may fly even under the electric field having a magnitude weaker than the magnitude E0 of the mono-layer toner start electric field. For this reason, it is considered that the magnitude E1 of the contact toner fly start electric field is lower than the magnitude E0 of the mono-layer toner fly start electric field.

Using this phenomenon, the contact toner may be configured so as to fly from an area on the surface of the development roller 7*a* which faces the non-exposed region of the photosensitive member 2. That is, at the position where the development roller 7*a* faces the non-exposed region of the photosensitive member 2, the magnitude of the toner fly electric field generated by the development bias Vb applied to the development roller 7*a* may be set to have a value which is sufficient to cause the non-contact toner to fly but insufficient to cause the contact toner to fly.

Figure 8:
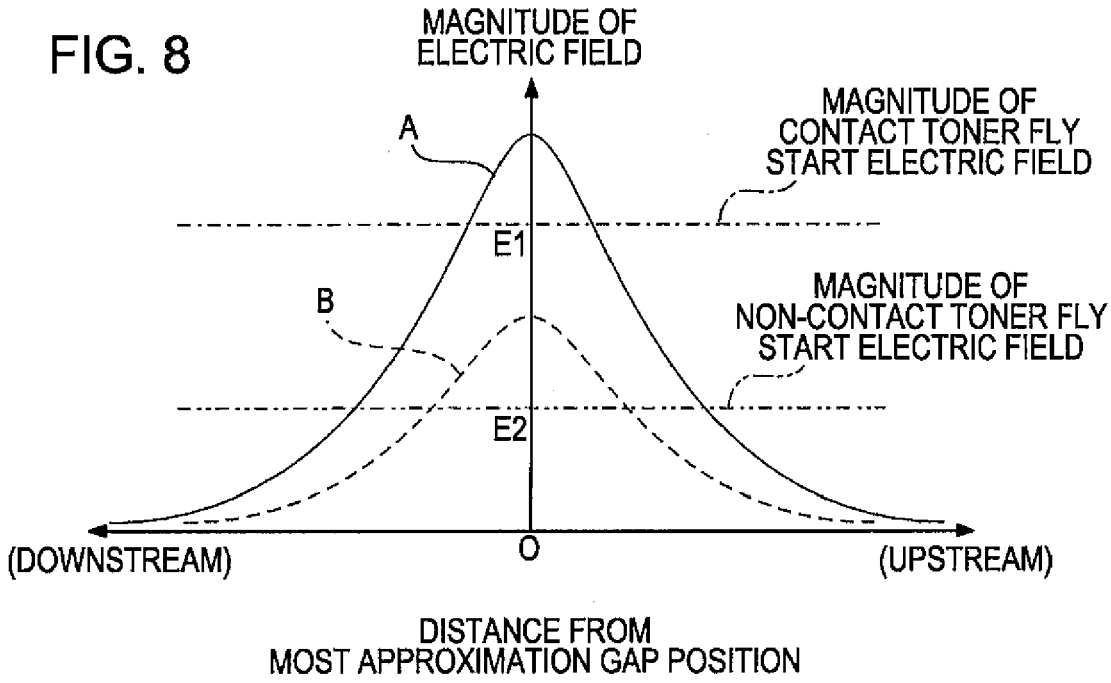
FIG. 8 is a graph illustrating a magnitude distribution of electric fields in the vicinity of the surface of a development roller.

FIG. 8 is a graph illustrating a magnitude distribution of the electric fields in the vicinity of the surface of the development roller. The horizontal axis of the graph in FIG. 8 represents the position of the surface of the development roller 7*a* when the development position DP is viewed from a rotational axis direction of the development roller 7*a*. That is, on the assumption that a position which the photosensitive member 2 and the development roller 7*a* approach is the origin O at the development position DP where the photosensitive member 2 with the substantially cylindrical shape and the development roller 7*a* face each other, each position on the circumferential surface of the development roller 7*a* is expressed by a distance from the origin O. The vertical axis of the graph represents the magnitude of the electric field when the polarity of the electric field (the toner fly electric field) becomes the polarity for causing the toner to fly from the surface of the development roller 7*a* at each position.

A value obtained by subtracting the size of a gap in each position from the potential difference between the photosensitive member 2 and the development roller 7*a* is the magnitude of the electric field at each position. However, since the surface potential is different between the exposed region and the non-exposed region on the surface of the photosensitive member 2, as described above, the magnitude of the electric field at each position on the surface of the development roller 7*a* depends on whether each position faces the exposed region or faces the non-exposed region on the photosensitive member 2. As apparent from FIG. 3, the magnitude of the electric field is higher in the position on the surface of the development roller 7*a* facing the exposed region on the photosensitive member 2 than in the position facing the non-exposed region. In addition, the magnitude of the electric field becomes the maximum at the position where the photosensitive member 2 is the closest to the development roller 7*a*. The magnitude of the electric field becomes lower as the photosensitive member 2 and the development roller 7*a* move away from the closest position. A curve A indicated by a full line in FIG. 8 represents the magnitude of the electric field (hereinafter, referred to as "an exposed region electric field") at the position facing the exposed region on the photosensitive member 2. A curve B indicated by a dashed line represents the magnitude of the electric field (hereinafter, referred to as "a non-exposed region electric field") at the position facing the non-exposed region on the photosensitive member 2.

In this embodiment, the magnitude of the electric field, which is indicated by the curve A in FIG. 8, at the closest gap position of the exposed region may be set to be higher than the magnitude E1 of the contact toner fly start electric field. The amplitude Vpp of the development bias Vb is set such that the magnitude of the non-exposed region electric field at the closest gap position of the non-exposed region indicated by the curve B is lower than the magnitude E1 of the contact toner fly start electric field and is higher than the magnitude E2 of the non-contact toner fly start electric field. Then, between the non-exposed region of the photosensitive member 2 and the development roller 7*a*, the non-contact toner carried on the development roller 7*a* is caused to fly but the contact toner is not caused to fly. In this way, since the contact toner is prevented from being attached to the non-exposed region of the photosensitive member 2, the ground fogging is effectively prevented.

On the other hand, when the magnitude of the exposed region electric field is set to be higher than the magnitude E1 of the contact toner fly start electric field, a sufficient development density can be obtained due to the flight of the non-contact toner and the contact toner in the exposed region. In addition, the reproducibility for the potential profile in the non-contact toner on the photosensitive member is low, but the reproducibility for the potential profile in the contact toner having the high charge amount is high. Therefore, even though a small variation in the potential may arise as the density variation, this defect is made up for by developing both the toners in a mixed state, thereby achieving the excellent image quality. That is, it is possible to realize a high image contrast in a fine line image. Moreover, it is possible to realize small density irregularity in an image having a broad area.

In this case, since the magnitude E1 of the electric field necessary to cause the contact toner to fly is lower than the magnitude E0 of the mono-layer toner fly start electric field, it is possible to restrain the magnitude of the electric field occurring in the development gap to be low. Accordingly, it is possible to prevent the toner from flying to the inside and outside of the image forming apparatus. Moreover, it is possible to prevent the discharge from occurring in the development gap.

Next, the configuration of the development unit 7 suitable for realizing the above-described development operation will be described. As described above, in this embodiment, the regular low-charge toner is trapped by carrying the toner containing two or more toner layers on the surface of the development roller, more particularly, carrying both the contact toner and the non-contact toner and by applying the reverse polarity charge to the attachments on the photosensitive member 2. In this way, both the ground fogging and the toner flying can be prevented. However, a problem arises in that the non-contact toner is detached from the surface of the development roller and caused to fly to the inside and outside of the image forming apparatus due to the rotation of the development roller since the restrictive force of the development roller exerted on the non-contact toner is weak.

In particular, this problem often arises in a configuration in which the toner is carried on the entire surface of a development roller of which the surface area is increased by performing the surface to blast processing, which has widely been used for some time. Even when the toner containing two or more layers is carried on the development roller having this configuration, the toner flying hardly occurs. In addition, even when the number of rotations of the development roller is increased to meet a request for improving a process speed, a lot of the toner detached from the surface of the development roller is caused to fly.

Until now, it has been considered that the detachment of the toner from the surface of the development roller was caused by the centrifugal force exerted on the toner. However, the study of the inventors reveals that an influence of the air stream occurring in the vicinity of the surface of the development roller due to the rotation of the development roller is the main reason for the detachment. In particular, it has been confirmed that the detachment of the toner from the surface of the development roller is more severe in the toner having a small particle diameter than in the toner having a large particle diameter even though the centrifugal force is smaller due to the small mass. It is considered that this is because the toner receives pressure from the wind made by the rotation of the development roller. Accordingly, in this embodiment, the configuration of the development unit 7 is realized in order to solve this problem.

Figure 9:
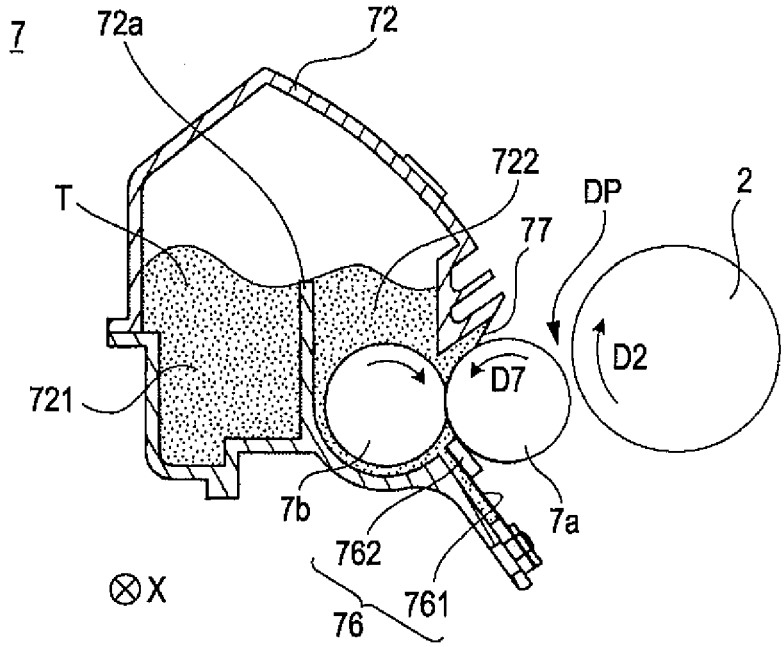
FIG. 9 is a sectional view illustrating the configuration of a development unit according to the embodiment.

FIG. 9 is a sectional view illustrating the configuration of the development unit according to this embodiment. In the development unit 7, a supply roller 7*b* and the development roller 7*a* are axially-attached to a housing 72 storing mono-component toner T therein. The development roller 7*a* is disposed to face the photosensitive member 2 at the development position DP with a predetermined gap therebetween. The rollers 7*a* and 7*b* engage with a rotation driving unit (not shown) provided in a main body to rotate in a predetermined direction. The supply roller 7*b* made of an elastic material such as urethane foam rubber or silicon rubber is formed in a cylindrical shape. The development roller 7*a* formed of a metallic tube made of a conductive material, such as metal such as copper or aluminum or alloy thereof, is formed in a cylindrical shape. By allowing the two rollers 7*a* and 7*b* to rotate in a contact manner, the toner is applied to the surface of the development roller 7*a* so that a toner layer having a predetermined thickness is formed on the surface of the development roller 7*a*.

The inner space of the housing 72 is divided into a first chamber 721 and a second chamber 722 by a partition wall 72*a*. Both the supply roller 7*b* and the development roller 7*a* are provided in the second chamber 722. The toner in the second chamber 722 flows with the rotation of these rollers and is supplied to the surface of the development roller 7*a* while being mixed.

The development unit 7 is provided with a regulating blade 76 for regulating the thickness of the toner layer formed on the surface of the development roller 7*a* to be a predetermined thickness. The regulating blade 76 includes a plate-shaped member 761 made of stainless, phosphor bronze, or the like and having elasticity and an elastic member 762 made of a resin material such as silicon rubber or urethane rubber and mounted in the front end of the plate-shaped member 761. The rear end of the plate-shaped member 761 is fixed to the housing 72. The elastic member 762 mounted in the front end of the plate-shaped member 761 is disposed to be located on the upstream side of the rear end of the plate-shaped member 761 in a rotational direction D7 of the development roller 7*a* indicated by an arrow in FIG. 9. The elastic member 762 forms a regulating nip by coming in elastic contact with the surface of the development roller 7*a* and finally regulates the toner layer formed on the surface of the development roller 7*a* to have the predetermined thickness.

The housing 72 is provided with a sealing member 77 which comes in pressing contact with the surface of the development roller 7*a* on the downstream side of a position (the development position DP) facing the photosensitive member 2 in the rotational direction D7 of the development roller 7*a*. The sealing member 77 made of a material having flexibility, such as polyethylene, nylon, or fluorine resin, is a strip-shaped film extending in a direction X parallel to the rotation axis of the development roller 7*a*. One end of the sealing member 77 is fixed to the housing 72 in a shorter direction perpendicular to the longer direction X and the other end thereof comes in contact with the surface of the development roller 7*a*. The other end of the sealing member 77 comes in contact with the development roller 7*a* in a so-called trail direction so as to be oriented to the downstream side in the rotational direction D7 of the development roller 7*a*, guides the toner remaining on the surface of the development roller 7*a* passing the position facing the photosensitive member 2 into the housing 72, and prevents the toner in the housing from leaking to the outside.

Figure 10:
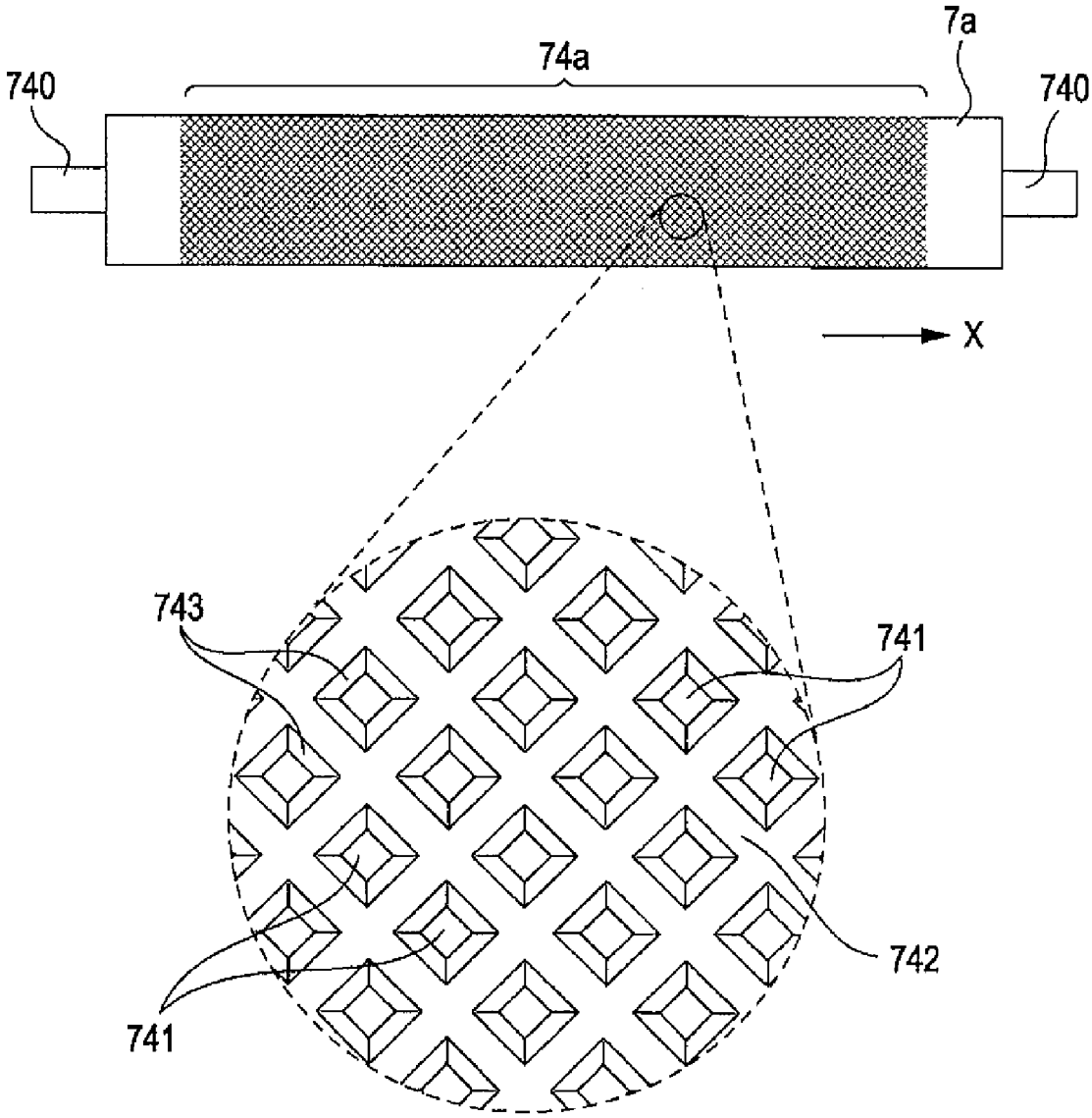
FIG. 10 is a partially enlarged view illustrating the development roller and the surface thereof.

FIG. 10 is a partial enlarged view illustrating the development roller and the surface thereof. The development roller 7*a* having the surface formed of a metallic tube made of a conductive material is formed in a substantially cylindrical roller shape. Shafts 740 are formed in both the ends in the longitudinal direction of the development roller 7*a* to be coaxial with the roller. The shafts 740 are supported by the main body of the developer so that the entire development roller 7*a* is rotatable. As shown in a partially enlarged view (within a dot line) of FIG. 10, a plurality of convexes 741 regularly arranged and concaves 742 surrounding the convexes 741 are formed in a middle portion 74*a* of the surface of the development roller 7*a*.

Each of the plurality of convexes 741 protrudes upward on the surface of the FIG. 10. The top surfaces of the convexes 741 form a part of a single cylindrical surface (a cylindrical envelop surface) having the same axis of the rotation axis of the development roller 7*a*. The concaves 742 each have continuously-formed grooves surrounding the circumference of the convex 741 in a net-like shape. All of the concaves 742 also form a single cylindrical surface having the same axis of the rotation axis of the development roller 7*a* and being different from the cylindrical surface formed by the convexes. Each convex 741 and each space between the concaves 742 surrounding the convex 741 are connected by a gentle slope surface 743. That is, the slope surface 743 has a component oriented outward (upward in FIG. 11) in a radial direction of the development roller 7*a*, that is, a direction moving away from the rotation axis as the development roller 7*a*. The development roller 7*a* having this configuration may be manufactured by a manufacturing method of using a rolling process disclosed in JP-A-2007-140080, for example. In this way, the regular and uniform unevenness can be formed on the cylindrical surface of the development roller 7*a*. Therefore, this development roller 7*a* is capable of carrying a uniform and optimum amount of toner on the cylindrical surface. A rolling property (easy-rolling) of the toner can be uniform on the cylindrical surface of the development roller 7*a*. As a consequence, by preventing local charge failure or transport failure of the toner, it is possible to achieve excellent development characteristics. In addition, since the unevenness is formed using a pattern, the width of the front end of each convex can be relatively enlarged in the obtained unevenness, unlike a general development roller manufactured by blast processing. This unevenness has an excellent mechanical strength. In particular, since a portion pressed by this shape is improved in a mechanical strength, the obtained unevenness has superior mechanical strength to that obtained by a cutting process. The development roller 7*a* with this unevenness has an excellent durability. When the width of the front end of the convex in the unevenness is relatively large, the shape change is small even though the convex wears down. Therefore, since the development characteristics are prevented from deteriorating abruptly, the excellent development characteristics can be maintained for a long time.

Figure 11A:
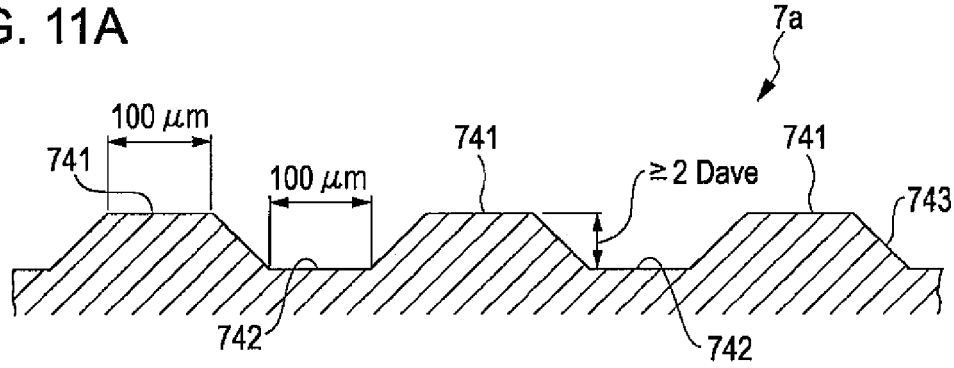
FIGS. 11A to 11D are sectional views illustrating the detailed configuration of the surface of the development roller.

FIGS. 11A to 11D are sectional views illustrating the detailed configuration of the surface of the development roller. When the surface of the development roller 7*a* is viewed in a cross-section direction, as shown in FIG. 11A, the convexes 741 protruding outward in the circumferential direction and the concaves 742 recessed relatively are alternately arranged. Each convex 741 and each concave 742 are connected by the slope surface 743. The size of the top surface of each convex 741 and the width of each concave 742 are about 100 μm, but the invention is not limited thereto. A difference in height between each convex 741 and the concave 742, in other words, the depth of each concave 742 having the groove shape surrounding the convex 741 is preferably larger than a volume average diameter Dave and is more preferably the double or more of the volume average diameter Dave.

Figure 11B:
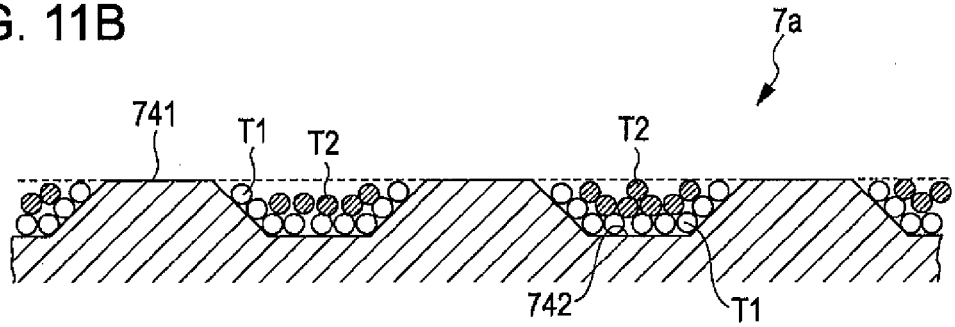

With such a configuration, as shown in FIG. 11B, it is possible to carry the toner of two or more layers on the concaves 742 without protruding outward over a line (a dashed line) connecting the top surfaces of the convexes 741 to each other. In FIG. 11B, white circles represent contact toner T1 which comes in direct contact with the surface of the development roller 7*a*. Hatching circles represent non-contact toner T2 which does not come in direct contact with the surface of the development roller 7*a* and is carried in the concaves 742.

The dashed line of FIG. 11B connecting the top surfaces of the convexes 741 is a curve on cylindrical envelop surface on the assumption that the top surface of each convex 741 is a part of one cylindrical surface. The fact that the toner carried in the concaves 742 does not cross the dashed line means that the toner is not exposed outward over the cylindrical envelope surface on the surface of the development roller 7*a*. Accordingly, even when a strong air stream arises on the surface of the development roller 7*a* due to the rotation of the development roller 7*a*, the strong air stream does not affect the toner carried at the position recessed from the surface of the development roller 7*a*. Moreover, it is possible to prevent the non-contact toner having a weak restrictive force to the development roller from flying.

Figure 11C:
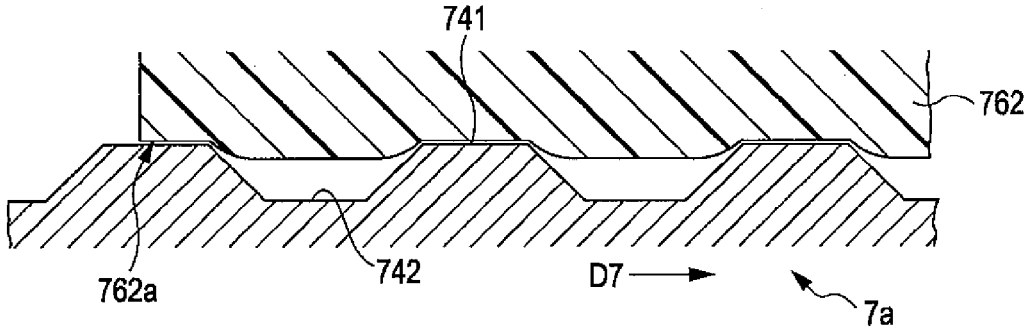

In order to carry the toner on the surface of the development roller 7*a*, as shown in FIG. 11B, the toner attachment to the convexes 741 is regulated by a so-called edge regulation in such a manner that an upstream edge 762*a* of the elastic member 762 of the regulating blade 76 on the upstream side in the rotational direction D7 of the development roller is brought into contact with the convexes 741 of the development roller 7*a*, as shown in FIG. 11C. In addition, by using the elastic member 762 and selecting a material having appropriate elasticity, the elastic member 762 slightly pushes the toner toward the concaves 742 at positions facing the concaves 742. In this way, the toner attachment to the convexes 741 is regulated and the toner is prevented from being carried in the concaves 742 over the cylindrical envelop surface.

Figure 11D:
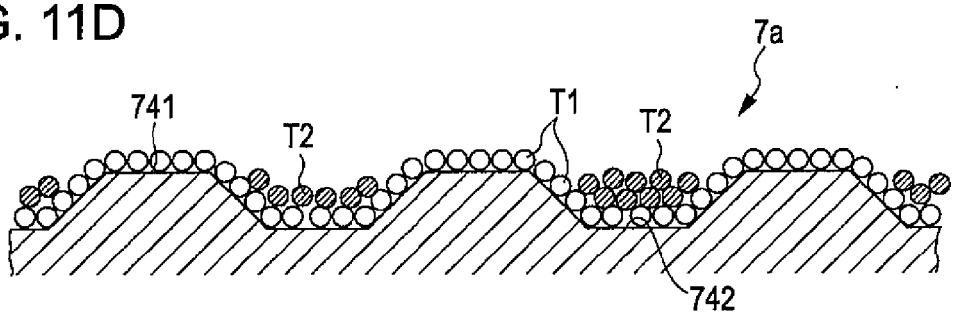

As described above, the strong restrictive force to the development roller 7*a* is exerted on the contact toner. Therefore, It is considered that this is difficult for the contact toner to be detached even when the contact toner has a high resistance property to the air stream and is exposed outward the cylindrical envelop surface. From this point of view, a contact angle, a contact pressure, or the like of the regulating blade 76 may be adjusted so that not more than one layer of the toner is attached on the convexes 741, as shown in FIG. 11D.

However, by carrying the toner only in the concaves 742, the following advantages can be obtained. First, in order to form the uniform toner layer on the convexes 741, it is necessary to precisely adjust the gap between the regulating blade 76 and the convexes 741. However, in order to carry the toner only in the concaves 742, the regulating blade 76 is brought into contact with the convexes 741 to remove all the toner on the convexes 741. Therefore, the realization is relatively easy. Moreover, since a transport amount of toner is determined by the size of the space between the regulating blade 76 and the concaves 742, the transport amount of toner can be stabilized.

There is an advantage from the standpoint of maintaining the good state of the toner layer to be transported. That is, when the toner is carried on the convexes 741, the toner may easily deteriorate due to the contact friction with the regulating blade 76. Specifically, a problem arises in that the fluidity or charge of the toner may deteriorate. Alternatively, a problem arises in that filming may be caused due to condensation or adhesion to the development roller 7*a* in a state where the toner is powered. In contrast, when the toner is carried in the concaves 742 which are rarely pressed by the regulating blade 76, no problem arises. Since the toner carried on the convexes 741 and the toner carried in the concaves 742 are greatly different in such a manner that the toners come in contact with the regulating blade 76, it is expected that irregularity in the charge of the toner is large. However, by carrying the toner only in the concaves 742, this irregularity is also restrained.

In particular, a request for a small diameter of the toner or a low fixing temperature has recently been made to realize high fineness in an image or reduce the amount of toner consumed and power consumption. The configuration according to this embodiment can satisfy this request. Since a saturation charge amount is high in the face of a slow increase in the charge of the toner having a small diameter, there is a tendency for the charge amount (excessive charge) of the toner carried on the convexes 741 considerably to increase, compared to the toner carried in the concaves 742. A difference in the charge amount is shown as so-called development history in an image. In the toner having a low melting point, adhesion of the toner or to the development roller 7*a* caused due to the contact friction is likely to occur. However, this problem barely arises in the configuration of this embodiment in which the toner is carried only in the concaves 742.

In this embodiment, the particle diameter of the toner used in this embodiment is not particularly limited. However, in particular a substantial advantage is achieved, when the toner having the volume average diameter Dave of 5 μm or less is used. It is difficult to cause the toner having this small diameter to fly from the development roller 44 due to the van der Waals force, since the particle diameter is small. Moreover, it is difficult from the toner to fly from the development roller 44 thanks to the image force exerted to the development roller 44 made of a conductive material. As a result, according to this embodiment, an excellent advantage can be achieved by the development method of carrying the toner containing two or more layers on the development roller 7*a* and causing both the contact toner and the non-contact toner to fly, thereby contributing to the development operation.

The toner having the volume average diameter equal to or smaller than about 5 μm has a strong property as powder and behaves in a different way from that of the toner having a larger diameter. For example, the mass of the toner having the small particle diameter is small. Therefore, once the toner flies, the toner floats for a long time. For this reason, the toner may leak outside the image forming apparatus as well as the inside thereof. However, in the image forming apparatus according to this embodiment, the toner is effectively prevented from flying. Therefore, no problem arises even when the toner having the small particle diameter is used.

In this embodiment, as described above, the toner containing two or more layers, more specifically, both the contact toner which comes in direct contact with the surface of the development roller and the non-contact toner which does not come in direct contact with the surface of the development roller, are carried on the surface of the development roller 7*a*. In this way, since the sufficient amount of toner can be transported to the development position DP, it is possible to obtain a high development density.

By carrying both the contact toner and the non-contact toner on the development roller, an advantage of sending off the contact toner when the non-contact toner starts flying can be achieved with a lower magnitude of the electric field. Therefore, the magnitude of the electric field generated at the development position DP may be low. By doing so, it is possible to prevent the toner flying at the development position DP from flying outside the gap. Moreover, it is possible to prevent the discharge from occurring in the gap.

After the surface of the photosensitive member 2 is charged with the regular polarity at the first charge position CP1 by the first charger 3, the second charger 5 applies the reverse polarity charge to the attachments (the toner or the external additives) attached on the surface of the photosensitive member 2 at the second charge position CP2. In this way, by trapping the lower charge toner flying at the development position DP in the attachments charged with the reverse polarity, it is possible to prevent the toner having the low charge amount from flying from the development roller 7*a* to the vicinity thereof.

Since the cleaning roller 4 is provided between the first charge position CP1 and the second charge position CP2, an unlimited increase in the attachments remaining on the surface of the photosensitive member 2 is prevented in advance. On the other hand, since the cleaning roller 4 includes the brush roller and does not remove the additives having a small particle diameter and colorants, free external additives which do not affect an image can remain on the photosensitive member 2 to some extent. Therefore, the free external additives can be effectively used as "the reverse polarity attachments".

By applying the transfer bias Vt1 having the high reverse polarity to the intermediate transfer belt 8*a*, the discharge is generated between the non-exposed region and the intermediate transfer belt 8*a* at the position TP0 in the rear of the development position DP and in the front of the transfer position TP in the rotational direction D2 of the photosensitive member 2. In this way, by applying the reverse polarity charge to the toner and the external additives attached to the non-exposed region of the photosensitive member 2 after the pass of the development position DP, it is possible to prevent the intermediate transfer belt 8*a* from being transferred at the transfer position TP. Accordingly, it is possible to further reduce the ground fogging.

In consideration of the fact that the contact toner and the non-contact toner are different in the magnitude of the fly start electric field, the magnitude of the toner fly electric field on the surface of the development roller facing the non-exposed region of the photosensitive member is set to as to be higher than the magnitude E2 of the non-contact toner fly start electric field and lower than the magnitude E1 of the contact toner fly start electric field. Then, by flying only the non-contact toner from the surface of the development roller facing the non-exposed region, the contact toner is prevented from flying. Accordingly, it is possible to further effectively prevent the ground fogging from occurring.

On the surface of the development roller facing the non-exposed region of the photosensitive member, the magnitude of the toner fly electric field is higher than the magnitude E1 of the toner fly electric filed. Therefore, since the flying of both the contact toner and the non-contact toner contributes to the development, it is possible to obtain the high development density. Moreover, by performing the development using both the contact toner and the non-contact toner, it is possible to produce an image of a satisfactory quality of in either an image with fine lines or an image having a broad area.

Since the toner is carried only in the concaves by forming the regular unevenness on the surface of the development roller and allowing the difference in the height to be the double or more of the volume average diameter, it is possible to reliably carry the toner containing two or more layers on the development roller 7*a*. Since the development roller 7*a* rotates in the state where the toner is received in the concaves, it is possible to prevent the toner from detaching from the surface of the development roller due to the rotation thereof.

Next, an image forming apparatus according to a second embodiment of the invention will be described. The configuration of the transfer unit 8 of the image forming apparatus according to the second embodiment is different from that of the image forming apparatus according to the first embodiment. However, the configuration and the operation of the units other than the transfer unit are fundamentally similar to those of the image forming apparatus according to the first embodiment. Therefore, the same reference numerals are given to the same constituent elements and a difference from the first embodiment will be mainly described.

Figure 12:
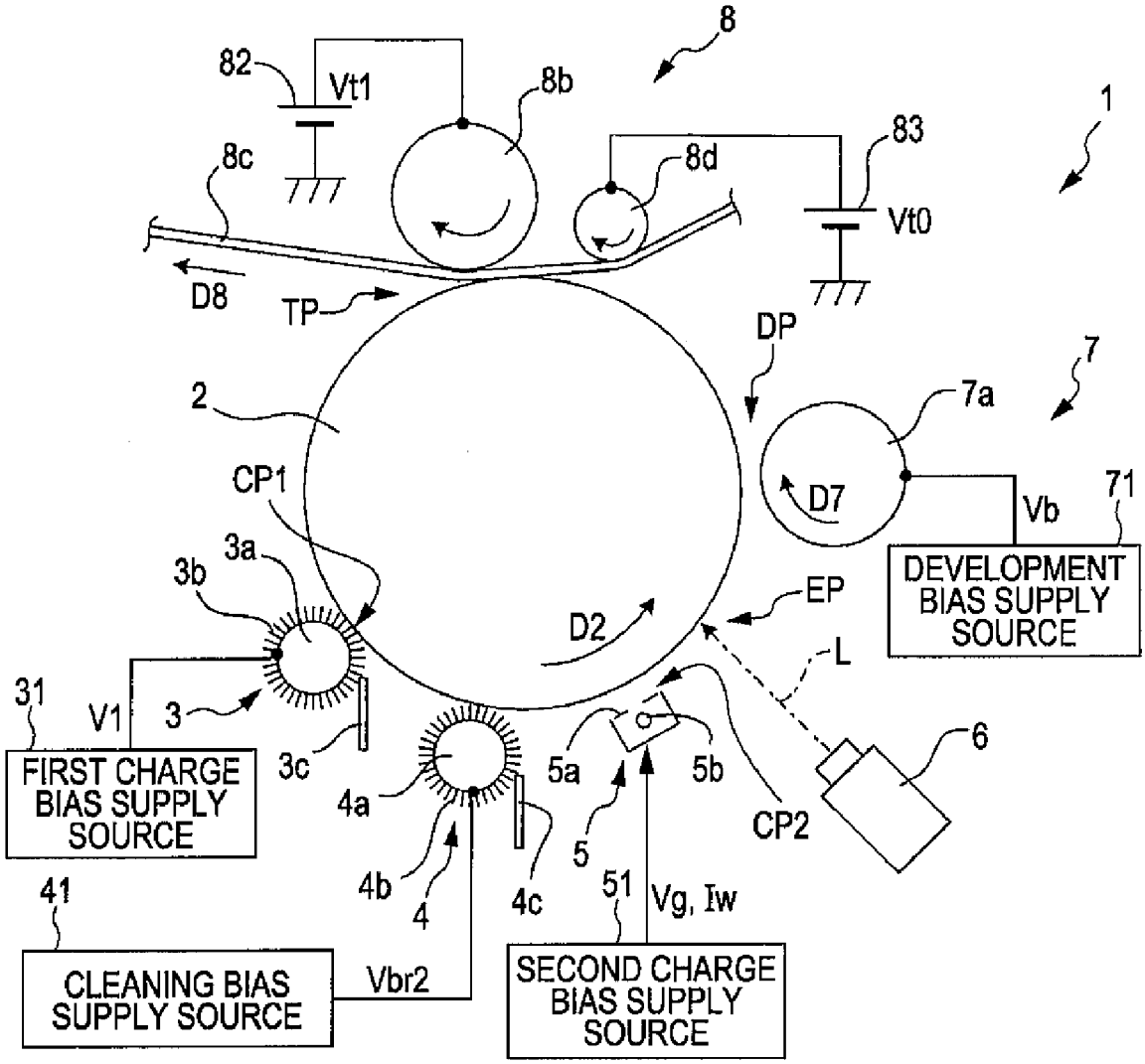
FIG. 12 is a diagram illustrating the main configuration of an image forming apparatus according to a second embodiment of the invention.

FIG. 12 is a diagram schematically illustrating the main configuration of an image forming apparatus according to the second embodiment of the invention. In the second embodiment, the transfer unit 8 is provided with a support roller 8*d*. The support roller 8*d* operates to more easily generate the discharge between the non-exposed region of the photosensitive member 2 and an intermediate transfer belt 8*c* by closely approximating the intermediate transfer belt 8*c* to the surface of the photosensitive member 2 on the upstream side of the transfer position TP in the rotational direction D2 of the photosensitive member 2. In this embodiment, unlike the image forming apparatus according to the first embodiment in which the transfer bias is applied to the intermediate transfer belt, a direct current potential of +600 V used as the transfer bias Vt1 is applied from a power source 82 to the backup roller 8*b* and a direct current potential Vt0 as a higher positive potential (+800 V) is applied from a power source 83 to the support roller 8*d*. In this way, like the above-described image forming apparatus according to the first embodiment, the reverse polarity charge is applied to the lower charge toner attached onto the photosensitive member 2 in the front of the transfer position TP. Therefore, it is possible to prevent the transfer to the intermediate transfer belt 8*c* at the transfer position TP.

As described above, in this embodiment, the photosensitive member 2 and the development roller 7*a* function as "a latent image carrier" and "a toner carrying roller" according to the invention, respectively. The development bias supply source 71 corresponds to "an electric field forming unit" according to the invention. The first charger 3 and the second charger 5 function as "a first charging unit" and "a second charging unit" according to the invention, respectively. The second charger 5 is a scorotron charger. The grid 5*a* and the charge wire 5*b* correspond to "a grid" and "a corona wire" according to the invention, respectively.

In this embodiment, the exposure unit 6 and the transfer unit 8 function as "a latent image forming unit" and "a transfer unit" according to the invention, respectively. The intermediate transfer belts 8*a* and 8*c* function as "a transfer medium" according to the invention. The cleaning roller 4 functions as "a cleaning unit" according to the invention. The regulating blade 76 functions as "a regulating member" according to the invention. The transfer bias supply source 81 and the power source 83 function as "a charge supply unit" according to the invention.

The invention is not limited to the above-described embodiment, but may be modified in various forms other than the above-described embodiment without departing from the gist of the invention. For example, each numerical value used to describe the embodiment is just an example. Moreover, the invention is not limited thereto.

In the above-described embodiment, the image forming apparatus has been used for forming a so-called negative latent image which is formed by attaching the toner to the area, where the charge is removed by the exposure, on the surface of the charged photosensitive member 2. The area (the exposed region) exposed on the photosensitive member 2 corresponds to "an image region" to which the toner is attached according to the invention. The area (the non-exposed region) which is not exposed corresponds to "a non-image region" according to the invention. However, the invention is applicable to an image forming apparatus for forming a so-called positive latent image which is formed by attaching toner to an area where the charge is generated by the exposure. In this case, the area exposed on the photosensitive member corresponds to "the image region" and the area which is not exposed corresponds to "the non-image region". In this embodiment, the negatively-charged toner has been used, but the invention is applicable to an image forming apparatus for using positively-charged toner.

The surface of the development roller 7*a* according to the above-described embodiment is formed by regularly arranging the convexes 741 each having the substantially rhombic top surface and the concaves 742 formed to surround the convexes. However, the shape of the convexes or the surface configuration of the development roller is not limited thereto. For example, a configuration in which several dimples are formed on the substantially flat cylindrical envelop surface or a configuration in which spiral grooves are formed thereon may be used. In this case, when the depth of the dimples or the grooves is the double or more of the volume average diameter of the toner, the toner containing two or more layers can be transported. From a standpoint of permitting fluidity of the toner on the surface of the development roller to prevent the toner adhesion to the concaves, it is preferable that the concaves carrying the toner communicate with each other.

In this embodiment, the number of development units 7 has not been particularly mentioned. However, the invention is appropriately applicable to a color image forming apparatus in which a rotatable rotary development unit is mounted with a plurality of development members, a tandem type image forming apparatus in which a plurality of development units are arranged around an intermediate transfer medium, a monochrome image forming apparatus in which only one development unit is provided to form a monochrome image, and so forth.

The entire disclosure of Japanese Patent Application No. 2008-232894, filed Sep. 11, 2008 is expressly incorporated by reference herein.

What is claimed is:

1. An image forming apparatus comprising:

a latent image carrier which rotates in a predetermined movement direction and carries an electrostatic latent image on a surface thereof;

a first charging unit which charges the latent image carrier with a surface potential having the same polarity as a charged polarity of toner at a first charge position;

a second charging unit which supplies a charge having a reverse polarity of the charged polarity of the toner toward the surface of the latent image carrier at a second charge position located on a downstream side of the first charge position in a movement direction of the latent image carrier;

a latent image forming unit which forms the electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region;

a toner carrying roller which is formed in a roller shape, is disposed to face the latent image carrier with a predetermined gap therebetween at a development position located on the downstream side of the latent image formation position in the movement direction of the latent image carrier, and carries a toner layer containing both a contact toner which comes in direct contact with the surface of the toner carrying roller and a non-contact toner which comes in contact with the contact toner and does not come in contact with the surface of the toner carrying roller;

an electric field forming unit which develops the electrostatic latent image by the toner at the development position by generating an alternating electric field as a toner fly electric field between the latent image carrier and the toner carrying roller; and a transfer unit which transfers a toner image formed by developing the electrostatic latent image to a transfer medium at a transfer position located on the downstream side of the development position in the movement direction of the latent image carrier, wherein the transfer unit includes a charge supply unit which supplies a charge having the reverse polarity of the charged polarity of the toner toward the non-image region on the surface of the latent image carrier between the development position and the transfer position, and a potential which does not exceed discharge limitation in the image region on the latent image carrier and exceeds the discharge limitation in the non-image region on the latent image carrier is applied to the charge supply unit.

2. The image forming apparatus according to claim 1, wherein the transfer unit applies a potential having the reverse polarity of the charged polarity of the toner to the transfer medium.

3. The image forming apparatus according to claim 1, wherein the second charge unit is a scorotron charger including a corona wire to which a potential having the reverse polarity of the charged polarity of the toner is applied and a grid to which a potential having the same polarity as the charged polarity of the toner is applied.

4. The image forming apparatus according to claim 1, wherein the first charging unit includes a contact member to which a potential having the same polarity as the charged polarity of the toner is applied and which comes in contact with the latent image carrier.

5. The image forming apparatus according to claim 1, wherein a surface of the toner carrying roller which carries the toner is made of a conductive material.

6. The image forming apparatus according to claim 1, wherein in the toner carrying roller, concaves for carrying the toner are formed on the cylindrical surface thereof and the depth of the concaves is the double or more of a volume average diameter of the toner.

7. The image forming apparatus according to claim 6, further comprising a regulating blade which regulates the toner layer formed on the surface of the toner carrying roller other than the concaves so as to be not more than one layer.

8. The image forming apparatus according to claim 6, further comprising a regulating member which regulates the toner so as not to be carried on the surface of the toner carrying roller other than the concaves.

9. The image forming apparatus according to claim 1, wherein a volume average diameter of the toner is 5 μm or less.

10. The image forming apparatus according to claim 1, wherein the cleaning unit is disposed at a downstream side of the first charge position.

11. The image forming apparatus according to claim 10, wherein the cleaning unit is a brush roller which comes in contact with the surface of the latent image carrier.

12. An image forming apparatus comprising:

a latent image carrier which rotates in a predetermined movement direction and carries an electrostatic latent image on a surface thereof;

a first charging unit which charges the latent image carrier with a surface potential having the same polarity as a charged polarity of toner at a first charge position;

a second charging unit which supplies a charge having a reverse polarity of the charged polarity of the toner toward the surface of the latent image carrier at a second charge position located on a downstream side of the first charge position in a movement direction of the latent image carrier;

a latent image forming unit which forms the electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region;

a toner carrying roller which is formed in a roller shape, is disposed to face the latent image carrier with a predetermined gap therebetween at a development position located on the downstream side of the latent image formation position, in the movement direction of the latent image carrier, and carries a toner layer containing both a contact toner which comes in direct contact with the surface of the toner carrying roller and a non-contact toner which comes in contact with the contact toner and does not come in contact with the surface of the toner carrying roller;

an electric field forming unit which develops the electrostatic latent image by the toner at the development position by generating an alternating electric field as a toner fly electric field between the latent image carrier and the toner carrying roller;

a transfer unit which transfers a toner image formed by developing the electrostatic latent image to a transfer medium at a transfer position located on the downstream side of the development position in the movement direction of the latent image carrier; and a cleaning unit which removes attachments attached on the surface of the latent image carrier, and is charged with the reverse polarity of the charged polarity of the toner, on the downstream side of the transfer position and the upstream side of the second charge position in the movement direction of the latent image carrier.

13. An image forming method comprising:

charging a rotating latent image carrier with a surface potential having the same polarity as a charged polarity of toner at a first charge position;

supplying a charge having a reverse polarity of the charged polarity of the toner toward the surface of the latent image carrier at a second charge position located on a downstream side of the first charge position in a movement direction of the latent image carrier;

forming an electrostatic latent image on the surface of the latent image carrier at a latent image formation position located on the downstream side of the second charge position in the movement direction of the latent image carrier by lowering a surface potential of an image region, where the toner is attached, on the surface of the latent image carrier and by allowing a surface potential of a non-image region, where no toner is attached, to be different from the surface potential of the image region;

disposing a toner carrying roller, which is formed in a roller shape and carries a toner layer containing both a contact toner which comes in direct contact with the surface of the toner carrying roller and a non-contact toner which comes in contact with the contact toner and does not come in contact with the surface of the toner carrying roller, to face the latent image carrier with a predetermined gap therebetween at a development position located on the downstream side of the latent image formation position in the movement direction of the latent image carrier;

developing the electrostatic latent image by the toner at the development position by generating an alternating electric field as a toner fly electric field between the latent image carrier and the toner carrying roller;

transferring a toner image formed by developing the electrostatic latent image to a transfer medium at a transfer position located on the downstream side of the development position in the movement direction of the latent image carrier; and removing attachments attached on the surface of the latent image carrier with a cleaning unit that is charged with the reverse polarity of the charged polarity of the toner, on the downstream side of the transfer position and the upstream side of the second charge position in the movement direction of the latent image carrier.

* * * * *